US006187421B1

(12) United States Patent
Moriguchi et al.

(10) Patent No.: US 6,187,421 B1
(45) Date of Patent: Feb. 13, 2001

(54) COATED TOOL OF CEMENTED CARBIDE

(75) Inventors: Hideki Moriguchi; Akihiko Ikegaya; Kazuo Yamagata, all of Hyogo (JP)

(73) Assignee: Sumitomo Electric Industries, Ltd., Osaka (JP)

( * ) Notice: Under 35 U.S.C. 154(b), the term of this patent shall be extended for 0 days.

(21) Appl. No.: 09/331,857

(22) PCT Filed: Nov. 6, 1998

(86) PCT No.: PCT/JP98/05004

§ 371 Date: Jun. 28, 1999

§ 102(e) Date: Jun. 28, 1999

(87) PCT Pub. No.: WO99/24198

PCT Pub. Date: May 20, 1999

(30) Foreign Application Priority Data

| | | |
|---|---|---|
| Nov. 6, 1997 | (JP) | 9-304312 |
| Jan. 22, 1998 | (JP) | 10-010054 |
| Oct. 23, 1998 | (JP) | 10-301898 |
| Oct. 23, 1998 | (JP) | 10-301902 |

(51) Int. Cl.[7] ..... B23B 27/14

(52) U.S. Cl. ..... 428/216; 51/307; 51/309; 407/119; 428/336; 428/698; 428/701; 428/702

(58) Field of Search ..... 428/216, 336, 428/698, 701, 702; 51/307, 309; 407/119

(56) References Cited

U.S. PATENT DOCUMENTS

| | | | | |
|---|---|---|---|---|
| 5,123,934 | * | 6/1992 | Katayama et al. | 51/309 |
| 5,624,766 | * | 4/1997 | Moriguchi et al. | 407/119 |
| 5,652,045 | * | 7/1997 | Nakamura et al. | 428/216 |

FOREIGN PATENT DOCUMENTS

| | | |
|---|---|---|
| 2-311202 | 12/1990 | (JP) . |
| 5-177411 | 7/1993 | (JP) . |
| 6-246512 | 9/1994 | (JP) . |
| 6-246513 | 9/1994 | (JP) . |
| 7-6066 | 1/1995 | (JP) . |
| 8-118105 | 5/1996 | (JP) . |
| 9-1403 | 1/1997 | (JP) . |

* cited by examiner

*Primary Examiner*—A. A. Turner
(74) *Attorney, Agent, or Firm*—McDermott, Will & Emery

(57) ABSTRACT

The principal object of the present invention is to provide a coated cemented carbide tool whose both properties of breakage resistance and wear resistance are improved and whose life is lengthened.

The present invention has been made to achieve this object and is related with a coated cemented carbide cutting tool comprising a substrate consisting of a matrix of WC and a binder phase of an iron group metal and a plurality of coated layers provided on a surface of the substrate, in which (a) an innermost layer, adjacent to the substrate, of the coated layers consists essentially of titanium nitride having a thickness of 0.1 to 3 $\mu$m, (b) on a mirror-polished cross-sectional microstructure of the said tool, an average crack interval in the coated film on a ridge of a cutting edge and/or rake face is smaller than an average crack interval in the coated layer on a flank face, (c) at least 50% of the cracks in the coated film on the said ridge of the cutting edge and/or rake face have ends of the cracks in the said innermost titanium nitride layer, in a layer above the titanium nitride layer or in an interface between these layers and (d) an average crack length in the coated film on the said ridge of the cutting edge and/or rake face is shorter than an average film thickness on the flank face.

According to the present invention, quantitatively specifying the crack intervals and positions of the ends of the cracks in the coated layer results in excellent breakage resistance as well as wear resistance.

34 Claims, 2 Drawing Sheets

COATED TOOL OF CEMENTED CARBIDE

TECHNICAL FIELD

This invention relates to a cutting tool, in particular, which is most suitable as a coated cemented carbide cutting tool used for cutting steels and cast irons and which is excellent in wear resistance as well as breakage resistance.

BACKGROUND TECHNIQUE

Hitherto, cemented carbides (WC-Co alloys or WC-Co alloys to which carbonitrides of Ti, Ta or Nb are added) have been used as a tool material for cutting metallic materials. However, as cutting speeds have lately been increased, a tendency of using cemented carbide tools comprising cemented carbide substrates coated with coated films consisting of carbides, nitrides, carbonitrides, carboxides, boronitrides or oxides of Group IVa, Va and VIa elements of the Periodic Table or Al or their solid solutions by CVD or PVD methods in a thickness of 3 to 15 $\mu$m is enhancing. The thickness of the coated films tends to further increase and CVD coated cemented carbides with a coating thickness of at least 20 $\mu$m have been proposed. In such CVD coated cemented carbide tools, there arises a problem that a tensile residual stress occurs in the coated film during cooling after the coating due to difference in coefficient of thermal expansion between the coated film and substrate, and the breakage resistance of the tool is thus lowered.

For a coated cemented carbide tool, on the other hand, it has been proposed in order to improve its breakage resistance, to introduce cracks into a coated film to be penetrated therethrough to a substrate by applying mechanical impact to a surface of a cemented carbide, for example, by blasting (JP-B-7-6066). In this proposed method, it is confirmed that the breakage resistance can be improved to some extent, but because of previously introducing cracks into the coated film to be penetrated therethrough to the substrate, Griffith' precrack length is increased, thus resulting in lowering of the breakage resistance, wear fluctuation of the coated film and deterioration of the wear resistance from the longer cracks.

As described above, the coated cemented carbide tools of the prior art have the problems that when the thickness of a coated film is increased to improve the wear resistance, the breakage resistance of the tool is decreased and even when cracks are previously introduced into a coated film with a relatively large thickness, the wear resistance is rather lowered depending on the cracked state. These problems have not been solved yet.

Under the situation, the present invention aims at providing a coated cemented carbide tool whose both properties of a breakage resistance and wear resistance are improved and service life as a tool is lengthened.

DISCLOSURE OF INVENTION

In order to achieve the above described object, the inventors have made various studies and consequently, have found that using a cemented carbide alloy consisting of a matrix of WC and a binder phase of an iron group metal, a ceramic film having a specified film quality and structure is coated onto its surface and the lengths and intervals of cracks introduced into the coated film are precisely controlled by a thermal or mechanical procedure, whereby to improve both the properties of a breakage resistance and wear resistance and to lengthen the tool life to a great extent. That is, the present invention comprises specified inventions or embodiments summarized below:

(1) A coated cemented carbide cutting tool comprising a substrate consisting of a matrix of WC and a binder phase of an iron group metal and a plurality of coated layers provided on a surface of the substrate, in which (a) an innermost layer, adjacent to the substrate, of the coated layers consists of titanium nitride having a thickness of 0.1 to 3 $\mu$m, preferably 0.3 to 1 $\mu$m, (b) on a mirror-polished cross-sectional microstructure of the said tool, an average crack interval in the coated film on a ridge of a cutting edge and/or rake face is smaller than an average crack interval in the coated layer on a flank face, (c) at least 50%, preferably at least 80% of the cracks in the coated film on the said ridge of the cutting edge and/or rake face have ends of the cracks in the said innermost titanium nitride layer, in a layer above the titanium nitride or in an interface between these layers and (d) an average crack length in the coated film on the said ridge of the cutting edge is shorter than an average coated film thickness on the flank face.

(2) The coated cemented carbide cutting tool as described in the above (1), wherein the interface between these layers is a interface between the innermost titanium nitride layer and the layer directly above the titanium nitride.

(3) The coated cemented carbide cutting tool as described in the above (1) or (2), wherein the said innermost titanium nitride layer is coated with titanium carbonitride layer of columnar structure with an aspect ratio of at least 5, preferably 10 to 50, having a thickness of 3 to 30 $\mu$m, preferably 5 to 15 $\mu$m, and further coated with at least one alumina layer of 0.5 to 10 $\mu$m, preferably 1 to 8 $\mu$m.

(4) The coated cemented carbide cutting tool as described in the above (3), wherein at least 50%, preferably 80 to 100% of the cracks in the coated film on the said ridge of the cutting edge and/or rake face have ends of the cracks, at the substrate side, in the said innermost titanium nitride layer, in the said titanium carbonitride layer of columnar structure or in an interface between the said titanium nitride layer and the said titanium carbonitride layer of columnar structure. (The existing amount of the ends of the cracks at the substrate side herein means the total mounts.)

(5) The coated cemented carbide cutting tool as described in the above (1) or (2), wherein the said innermost titanium nitride layer is coated with alumina layer of 3 to 20 $\mu$m, further coated with titanium carbonitride layer of columnar structure having a thickness of 3 to 30 $\mu$m with an aspect ratio of at least 5 and further coated with alumina layer of 0.5 to 10 $\mu$m.

(6) The coated cemented carbide cutting tool as described in any one of the above (1) to (5), wherein the average crack interval in the coated film on the said ridge of the cutting edge and/or rake face is at most 10 $\mu$m.

(7) The coated cemented carbide cutting tool as described in any one of the above (1) to (6), wherein when a narrower average crack interval in the coated film of the ridge of the cutting edge or rake face on the said cross-sectional microstructure is X and an average value of the crack intervals in the coated film on the flank face is Y, a value of Y/X satisfies at least 2.

(8) The coated cemented carbide cutting tool as described in any one of the above (1) to (7), wherein at least 50%, preferably 75 to 100% of the ends of the cracks at the surface side in the coated film on the said ridge of the cutting edge and/or rake face are not penetrated to the surface of the coated film.

(9) The coated cemented carbide cutting tool as described in any one of the above (2) to (8), wherein at least 50%, preferably 70 to 100% of the cracks in the coated film on the said ridge of the cutting edge and/or rake face exist in only the said titanium carbonitride film of columnar structure and are not penetrated to the upper and lower layers thereof.

(10) The coated cemented carbide cutting tool as described in any one of the above (1) to (9), wherein the surface of the said cemented carbide substrate has a β-free layer.

(11) The coated cemented carbide cutting tool as described in any one of the above (1) to (10), wherein the cracks in the coated film on the said ridge of the cutting edge are mechanically introduced after coating.

(12) The coated cemented carbide cutting tool as described in any one of the above (3) to (11), wherein the said titanium carbonitride layer of columnar structure is coated at 800° C. to 1000° C., preferably, 850° C. to 950° C. by a CVD method comprising using an organo CN compound as a reactant gas.

(13) The coated cemented carbide cutting tool as described in any one of the above (1) to (12), wherein the total thickness of the coated films is in a range of 3 to 50 μm.

(14) A coated cemented carbide cutting tool comprising a substrate consisting of a matrix of WC and a binder phase of an iron group metal and a plurality of coated layers provided on a surface of a substrate, in which (a) an innermost layer, adjacent to the substrate, of the coated layers consists of titanium nitride having a thickness of 0.1 to 3 μm, preferably 0.3 to 1 μm, which is further coated with, as an upper layer, at least one alumina layer of 0.5 to 10 μm, preferably 1 to 8 μm, (b) on a mirror-polished cross-sectional microstructure of the tool, an average crack interval in the coated film on a ridge of a cutting edge is smaller than an average crack interval in the coated layer on a flank face, (c) at least 50 % of the cracks in the coated film on the said ridge of the cutting edge have ends of the cracks, at the substrate side, in the said innermost titanium nitride layer, in a layer above the titanium nitride layer or in an interface between these layers (interface between the titanium nitride layer and a layer directly above it and each interface between the layers in the upper layers), (d) an average crack length in the coated film on the said ridge of the cutting edge is shorter than an average coated film thickness on the flank face and (e) the said alumina layer is removed or polished on at least a part of the ridge of the cutting edge.

(15) The coated cemented carbide cutting tool as described in the above (14), wherein the said innermost titanium nitride layer is further coated with titanium carbonitride layer of columnar structure with an aspect ratio of at least 5, preferably 10 to 50, having a thickness of 3 to 30 μm, preferably 5 to 15 μm, and further coated with at least one alumina layer with a thickness of 0.5 to 10 μm, preferably 1 to 8 μm.

(16) The coated cemented carbide cutting tool as described in the above (15), wherein at least 50%, preferably 80 to 100% of the cracks in the coated film on the said ridge of the cutting edge have ends of the cracks, at the substrate side, in the said innermost titanium nitride layer, in the said titanium carbonitride layer of columnar structure or in an interface between the said titanium nitride layer and the said titanium carbonitride layer of columnar structure. (The existing amount of the ends of the cracks at the substrate side herein means the total mounts.)

(17) The coated cemented carbide cutting tool as described in any one of the above (14) to (16), wherein the average crack interval in the coated film on the said ridge of the cutting edge is at most 10 μm.

(18) The coated cemented carbide cutting tool as described in any one of the above (14) to (17), wherein when an average crack interval in the coated film of the ridge of the cutting edge on the said cross-sectional microstructure is X and an average crack interval in the coated film on the flank face is Y, a value of Y/X satisfies at least 2, preferably at least 5.

(19) The coated cemented carbide cutting tool as described in any one of the above (14) to (18), wherein the crack interval in the surface-exposed coated layer A, at which the said alumina layer has been removed, is 0.5 to 5 μm, preferably 1 to 3 μm.

(20) The coated cemented carbide cutting tool as described in any one of the above (15) to (18), wherein the surface-exposed coated layer A, at which the said alumina layer has been removed, consists of titanium carbonitride of a columnar crystal with an aspect ratio of at least 5, preferably 10 to 50, having a thickness of 3 to 30 μm, preferably 5 to 15 μm.

(21) The coated cemented carbide cutting tool as described in any one of the above (14) to (18), wherein the coated layer A provided with cracks whose intervals in a range of 0.5 to 5 μm, preferably 1 to 3 μm exists under the said alumina polished part.

(22) The coated cemented carbide cutting tool as described in any one of the above (15) to (18), wherein the coated layer A existing under the said alumina-polished part consists of titanim carbonitride layer of columnar structure, with an aspect ratio of at least 5, preferably 10 to 50, having a thickness of 3 to 30 μm, preferably 5 to 15 μm.

(23) The coated cemented carbide cutting tool as described in any one of the above (15) to (20), wherein at least 50%, preferably 70 to 100% of the cracks in the coated film on the said ridge of the cutting edge exist on only the said titanium carbonitride layer of columnar structure and are not penetrated through the upper and lower coated layers thereof.

(24) The coated cemented carbide cutting tool as described in any one of the above (14) to (23), wherein the surface of the said cemented carbide substrate has a β-free layer.

(25) The coated cemented carbide cutting tool as described in any one of the above (14) to (20) and (23) to (24), wherein the said removed alumina layer essentially consists of κ-alumina.

(26) The coated cemented carbide cutting tool as described in any one of the above (14) to (18) and (21) to (23), wherein the said polished alumina layer essentially consists of α-alumina.

(27) A coated cemented carbide cutting tool comprising a substrate consisting of a matrix of WC and a binder phase of an iron group metal and a plurality of coated layers provided on a surface of the substrate, in which (a) an innermost layer, adjacent to the substrate, of the coated layers consists of titanium nitride having a thickness of 0.1 to 3 μm, preferably 0.3 to 1 μm, which is further coated with titanium carbonitride layer of columnar structure with an aspect ratio of at least 5, preferably 10 to 50, having a thickness of 3 to 30 μm, preferably 5 to 15 μm, and further coated with at least one alumina layer with a thickness of 0.5 to 10 μm, preferably 1 to 8 μm, (b) on a mirror-polished cross-sectional microstructure of the tool, at least 50% of ends of cracks at the surface side in the coated film on a ridge of a cutting edge and/or rake face are not penetrated to the surface of the coated film, (c) at least 50% of the cracks in the coated film on the said ridge of the cutting edge and/or rake face have ends of the cracks, at the substrate side, in the said innermost titanium nitride layer, in a layer above the titanium nitride layer or in an interface between these layers and (d) an average crack length in the coated film on the said ridge of the cutting edge and/or rake face is shorter than an average coated film thickness on the flank face, (e) an average crack inerval in the said titanium carbonitride layer on the said ridge of the cutting edge and/or rake face is at most 10 μm and (f) an average crack interval in the said alumina film on the said ridge of the cutting edge and/or rake face is at least two times as large as an average crack interval in the said titanium carbonitride layer.

(28) The coated cemented carbide cutting tool as described in the above (27), wherein the surface of the said cemented carbide substrate has a β-free layer.

(29) The coated cemented carbide cutting tool as described in the above (27) or (28), wherein the said alumina layer is removed or polished on at least a part of the ridge of the cutting edge.

(30) The coated cemented carbide cutting tool as described in any one of the above (14) to (29), wherein the cracks in the coated film on the said ridge of the cutting edge are mechanically introduced after coating.

(31) The coated cemented carbide cutting tool as described in any one of the above (15) to (30), wherein the said titanium carbonitride layer of columnar structure is coated at 800° C. to 1000° C., preferably, 850° C. to 950° C. by a CVD method comprising using an organo CN compound as a reactant gas.

(32) The coated cemented carbide cutting tool as described in any one of the above (14) to (31), wherein the sum of the thickness of the coated layers is in a range of 3 to 50 μm.

Between the said innermost titanium nitride layer and the said titanium carbonitride layer of columnar structure or the alumina layer of the above described (5) or between the said titanium carbonitride layer of columnar structure and the said alumina layer, an intermediate layer can be coated to improve the adhesive strength between these layers. As the intermediate layer, there can be used layers of titanium boronitride, titanium carbide, titanium carboxynitride and the like with a thickness of about 0.1 to 5 μm.

BEST EMBODIMENT FOR CARRYING OUT PRESENT INVENTION

Figure 1:
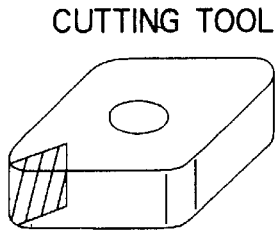
FIG. 1 is a perspective view of an insert of the present invention to illustrate a edge of a cutting edge, flank face and rake face.

According to the first feature I of the present invention, in a coated cemented carbide cutting tool comprising a substrate consisting of a matrix of WC and a binder phase of an iron group metal, to which a carbonitride of Ti, Ta, Nb, etc. is optionally added, and a plurality of coated layers provided on a surface of the substrate, (a) an innermost layer, adjacent to the substrate, of the coated layers consists of titanium nitride having a thickness of 0.1 to 3 μm, preferably 0.3 to 1 μm, which is further coated with titanium carbonitride layer of columnar structure with an aspect ratio of at least 5, preferably 10 to 50, having a thickness of 3 to 30 μm, preferably 5 to 15 μm, and further coated with at least one alumina layer with a thickness of 0.5 to 10 μm, preferably 1 to 8 μm. (b) On a mirror-polished cross-sectional microstructure of the said tool, an average crack interval in the coated film on the ridge of the cutting edge is rendered smaller than an average crack interval in the coated layer on a flank face. (c) Of the cracks in the coated film on the ridge of the cutting edge and/or rake face, those in which the ends of the cracks, at the substrate side, exist in the said innermost titanium nitride layer, in a layer above the titanium nitride or in an interface between these layers are in a proportion of at least 50%, preferably 80 to 100%. In the case of coating the said titanium carbonitride layer of columnar structure onto the said innermost titanium nitride layer, the cracks whose ends exist in the said innermost titanium nitride layer, in the said titanium carbonitride layer of columnar structure or in an interface between the said titanium nitride layer and the said titanium carbonitride layer of columnar structure are in a proportion of at least 50 %, preferably 80 to 100%. (d) It is important that an average crack length in the coated film on the said ridge of the cutting edge and/or rake face is shorter than an average coated film thickness on the flank face.

In the above described feature I of the present invention, the grounds for specifying (a) to (d) and other inventions will now be illustrated:

(a) The reason for choosing titanium nitride as the innermost layer consists in that not only the titanium nitride is excellent in adhesive strength to a cemented carbide material, but also is very excellent as a film quality capable of preventing cracks in the coated film from penetration to the substrate. The thickness thereof is specified as above, since if less than 0.1 μm, the effect thereof cannot be expected, while if more than 3 μm, the wear resistance is lowered. The titanium carbonitride film above it is preferably coated from the standpoint of wear resistance and use of a columnar structure with an aspect ratio of at least 5 results in easy introduction of cracks and formation of a tenacious film itself. When the aspect ratio is in a range of 10 to 50, in particular, excellent properties can be expected. The thickness thereof is specified as described above, since if less than 3 μm, the effect of improving the wear resistance becomes smaller, while if more than 30 μm, the breakage resistance is markedly lowered. The alumina layer above it is necessary from the standpoint of suppressing wear on the rake face when subjecting steels to high speed cutting. If the thickness is less than 0.5 μm, the effect thereof is smaller, while if more than 10 μm, the breakage resistance is markedly lowered.

(b) When the average crack interval in the coated film on the ridge of the cutting edge and/or rake face is smaller than an average crack interval in the coated layer on a flank face while observing the cross-sectional microstructure of the tool after mirror-polishing by means of an optical microscope or scanning electron microscope, the breakage resistance during intermittent cutting is improved and in addition, breaking, falling-off or peeling phenomena of the films due to excessive introduction of cracks into coated film on the flank face, on which the wear resistance is dependent, can be suppressed. This is preferable. In particular, these effects remarkably appear when a value of Y/X satisfies at least 2, wherein a narrower average crack interval in the coated film of the ridge of the cutting edge or rake face on the cross-sectional microstructure is X and an average crack interval in the coated film on the flank face is Y.

Figure 2:
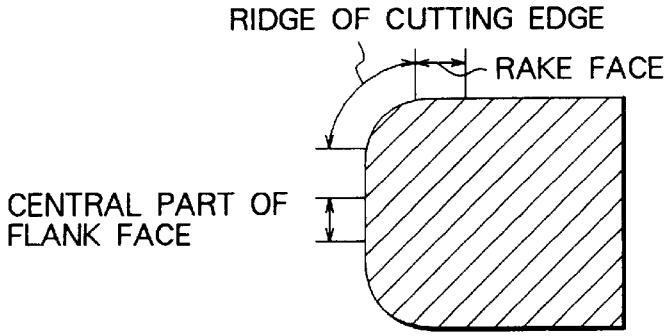
FIG. 2 is a typical plan view of an insert of the present invention.
Figure 3:
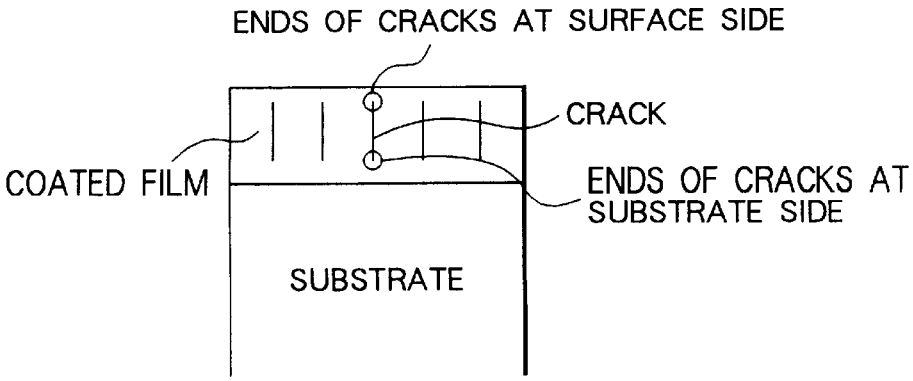
FIG. 3 is a diagram for showing a positional relationship between ends of cracks and a subatrate in a coated layer of a cemented carbide according to the present invention.

In this specification, the ridge of the cutting edge means a central part of the ridge of the cutting edge (range of upto a connection part with a rake face or flank face), the flank face means a central part of the flank face and the rake face means a position of approaching by 0 to 100 μm from the connection part of the ridge of the cutting edge with the rake face to the rake face side (Cf. FIG. 1 and FIG. 2). The above described observation of the cross-sectional microstructure by the optical microscope or scanning electron microscope is carried out to estimate an introduced state of cracks by photographing a designated site of the coated film by a length of about 50 to 100 μm and utilizing the same. When the number of the cracks introduced are smaller in the observed visual field, the visual field is lengthened. The cracks herein referred mean cracks introduced in the vertical direction to the coated film surface by a length of at least ½ of the film thickness of each coated layer (Cf. FIG. 3). This is probably due to the fact that when cracks each having a crack length of at least ½ of the thickness of each layer are introduced, in particular, the film of each layer is rendered tenacious to imrpove cutting property. In addition, when the average crack intervals in the coated layers respectively differ, the smallest average crack interval is acknowledged as the average crack interval of the present invention.

The cracks referred in the present invention include cracks introduced during grinding or mirror-polishing, which crack leangths or crack intervals can be measured by the above described measurement method or a method mentioned in the following Examples.

(c) When, of the cracks in the coated film on the ridge of the cutting edge and/or rake face, those in which the ends of the cracks, at the substrate side, exist in the said innermost titanium nitride layer, in the said titanium carbonitride layer of columnar structure or in an interface between the said titanium nitride layer and the said titanium carbonitride layer of columnar structure are in a proportion of at least 50%, the proportion of cracks penetrated to the substrate is small so that such a phenomenon can be suppressed that the cemented carbide substrate tends to break or fracture from the cracks penetrated through the substrate, as a stress-concentrated source, during intermittent cutting or the cemented carbide directly below the coated film is broken to peel off the coated film and lower the wear resistance. In this case, a proportion of at least 80% is particularly preferred. Because of the above described reason, this specifying includes also a case where the ends of the cracks, at the substrate side, exist in the interface between the innermost titanium nitride layer and substrate, and are not penetrated to the substrate.

(d) When the average crack length in the coated film on the said ridge of the cutting edge and/or rake face is shorter than the average coated thickness on the flank face, the cracks penetrated from the surface to the substrate are decreased and breakage of the cemented carbide substrate due to oxidation of the cemented carbide substrate at the ends of the cracks penetrated through the substrate during cutting at high speed and increase of wearing due to peeling of the film can be suppressed. This is preferred.

Furthermore, when the said innermost titanium nitride layer is further coated with alumina layer of 3 to 20 μm, further coated with titanium carbonitride layer of columnar structure with an aspect ratio of at least 5, having a thickness of 3 to 30 μm, and further coated with alumina layer of 0.5 to 10 μm, a wear resistance can be satisfied both at high speeds and low speeds. The reason for limiting the thickness of the inner alumina layer to 3 to 20 μm consists in that if thinner than 3 μm, its effect is less, while if thicker than 20 μm, the breakage resistance is largely deteriorated. The reason for limiting the thickness of the outer alumina layer to 0.5 to 10 μm consists in that if thinner than 0.5 μm, its effect is less, while if thicker than 10 μm, the wear resistance is deteriorated.

When the average crack interval in the coated film on the said ridge of the cutting edge and/or rake face is at most 10 μm, furthermore cutting stress loaded on the ridge of the cutting edge can be prevented from concentration on specified crack ends, that is, the stress can be dispersed, thus improving the breakage resistance, suppressing abnormal abrasion and improving the wear resistance.

When, of the cracks in the coated film on the ridge of the cutting edge and/or rake face, those in which the ends of the cracks, at the surface side, are not penetrated to the surface of the coated film exist in a proportion of at least 50%, a rapid abrasion-increasing phenomenon due to deterioration of the film quality, breakage of the film and peeling of the film, which are caused by a high temperature generated during high speed cutting and then through oxidation of the coated film, can be suppressed.

During the same time, in particular, when at least 50% of the cracks in the coated film on the said ridge of the cutting edge exists in only the said titanium carbonitride layer of columnar structure and are not penetrated to the upper and lower layers thereof, the cracks are hardly propagated in parallel to the film surface and hardly integrated with each other even under such a cutting condition that impacts are repeatedly loaded as in intermittent cutting and a rapid wear-increasing phenomenon due to adhesion breakage resulting from chipping of the film and due to peeling of the film can be suppressed, because grain shape of the titanium carbonitride layer of columnar structure is columnar.

In the coated cemented carbide having the above described feature I according to the present invention, the total film thickness of the coatings is preferably in a range of 3 to 50 μm.

When the surface of the said cemented carbide has a β-free layer (layer having no other precipitates than WC and a binder metal), cracks are hard to be propagated and the breakage resistance can further be improved because of improved toughness on the surface area of the cemented carbide when the cracks are allowed to progress through the substrate by cutting stress. Furthermore, when there is a higher hardness area directly below the β-free layer, than hardness inside the alloy, balance of the breakage resistance and wear resistance is improved. The β-free layer can be obtained by sintering a cemented carbide composition powder containing a nitride and/or carbonitride in a denitrization atmosphere, e.g. in vacuum. Its thickness is preferably 5 to 50 μm.

According to the second feature II of the present invention, in a coated cemented carbide cutting tool comprising a substrate consisting of a matrix of WC and a binder phase of an iron group metal, optionally further containing a carbonitirde of Ti, Ta, Nb, etc., and a plurality of coated layers provided on a surface of the substrate, (a) an innermost layer, adjacent to the substrate, of the coated layers consists essentially of titanium nitride having a thickness of 0.1 to 3 μm, preferably 0.3 to 1 μm, which is further coated with at least one alumina layer having a thickness of 0.5 to 10 μm, preferably 1 to 5 μm. Preferably, titanium carbonitride layer of columnar structure with an aspect ratio of at least 5, preferably 10 to 50, having a thickness of 3 to 30 μm, preferably 5 to 15 μm is further coated between the said titanium nitride and the said alumina. (b) On a mirror-polished cross-sectional microstructure of the said tool, an average crack interval in the coated film on the ridge of the cutting edge is rendered smaller than an average crack interval in the coated layer on a flank face. (c) Of the cracks in the coated film on the ridge of the cutting edge and/or rake face, those in which the ends of the cracks, at the substrate side, exist in the said innermost titanium nitride layer, in a layer above the titanium nitride or in an interface between these layers are in a proportion of at least 50%, preferably 80 to 100%. In the case of coating the said titanium carbonitride layer of columnar structure onto the said innermost titanium nitride layer, the cracks whose ends exist in the said innermost titanium nitride layer, in the said titanium carbonitride layer of columnar structure or in an interface between the said titanium nitride layer and the said titanium carbonitride layer of columnar structure exist in a proportion of at least 50%, preferably 80 to 100%. (d) An average crack length in the coated film on the said ridge of the cutting edge is shorter than an average coated film thickness on the flank face. (e) It is herein important that at least one layer of the said alumina layers is removed at least on a part of the ridge of the cutting edge.

In the third feature III of the present invention, the above described (a) to (d) are similarly accepted and as (e), it is important that the said alumina layer is polished at least on a part of the ridge of the cutting edge.

In the above described features II and III, the grounds for specifying (a) to (e) and other inventions will now be illustrated.

(a) The reason for choosing titanium nitride as the innermost layer consists in that not only the titanium nitride is excellent in adhesive strength to a cemented carbide material, but also is very excellent as a film quality capable of preventing cracks in the coated film from penetration to the substrate. The thickness thereof is specified as above, since if less than 0.1 μm, the effect thereof cannot be expected, while if more than 3 μm, the wear resistance is lowered. Further, the alumina film above it is necessary from the standpoint of suppressing wear on the rake face when subjecting steels or cast irons to high speed cutting. If the thickness is less than 0.5 μm, the effect thereof is smaller, while if more than 10 μm, the breakage resistance is markedly lowered. A particularly preferred range is 1 to 5 μm. (In feature III, a preferred range is 3 to 8 μm.) In this case, a plurality of alumina layers can be provided, which can optionally be sandwich-wise laminated with TiN, TiCN, TiC, TiBN, TiBNO layers, etc. Furthermore, inside the alumina layer can suitably be provided each layer of TiC, TiBN, TiN, TiBNO, TiCO and TiCNO and outside the alumina layer can suitably be provided each layer of TiCN, TiBN and TiN. In the case of providing a TiCNO layer between a TiCN layer and an $Al_2O_3$ layer, for example, the TiCNO layer serves to increase the adhesive strength of both the layers and the TiN layer outside the alumina layer serves to classify by coloring a used corner during cutting or improve a value as a commercial article by rendering golden. As an adjacent layer to the innermost TiN layer, there can be provided each layer of TiC, TiBN, TiCNO and TiCO in addition to the TiCN and $Al_2O_3$ layers. More preferably, a titanium carbonitride layer is coated between the said titanium nitride layer and the said alumina layer. This titanium carbonitride layer is preferably coated from the standpoint of wear resistance and use of a columnar structure layer with an aspect ratio of at least 5 results in easy introduction of cracks and formation of a tenacious film itself. When the aspect ratio is in a range of 10 to 50, in particular, excellent properties can be expected. The thickness thereof is specified as described above, since if less than 3 μm, the effect of improving the wear resistance becomes smaller, while if more than 30 μm, the breakage resistance is markedly lowered. As the above described $Al_2O_3$, any crystal type can be used, but depending on the object, κ-$Al_2O_3$ or α-$Al_2O_3$ can properly be used since κ-$Al_2O_3$ can readily be removed while α-$Al_2O_3$ having a higher toughness than κ-$Al_2O_3$ is hard to be removed.

(b) When the average crack interval in the coated film on the ridge of the cutting edge is smaller than an average crack interval in the coated layer on a flank face while observing the cross-sectional microstructure of the tool after mirror-polishing by means of an optical microscope or scanning electron microscope, the breakage resistance during intermittent cutting is improved and in addition, breaking, falling-off or peeling phenomena of the films due to excessive introduction of cracks into coated film on the flank surface, on which the wear resistance is dependent, can be suppressed. This is preferable. In particular, these effects remarkably appear when a value of Y/X satisfies at least 2, when a narrower average crack interval in the coated film of the ridge of the cutting edge or rake face on the cross-sectional microstructure is X and an average crack interval in the coated film of the flank face is Y.

In this specification, the ridge of the cutting edge means a central part of the ridge of the cutting edge (range of upto a connection part with a rake face or flank face), the flank face means a central part of the flank face and the rake face means a position of approaching by 0 to 100 μm from the connection part of the ridge of the cutting edge with the rake face to the rake face side (Cf. FIG. 1 and FIG. 2). The above described observation of the cross-sectional microstructure by the optical microscope or scanning electron microscope is carried out to estimate an introduced state of cracks by photographing a designated site of the coated film by a length of about 50 to 100 μm and utilizing the same. When the number of the cracks introduced are smaller in the observed visual field, the visual field is lengthened and when the designated site has a length of only less than 50 μm, only a measurable distance is to be employed as a measuring visual field. The cracks herein referred mean cracks introduced in the vertical direction to the coated film surface by a length of at least ½ of the film thickness of each coated layer (Cf. FIG. 3). This is probably due to the fact that when cracks each having a crack length of at least ½ of the thickness of each layer are introduced, in particular, the film of each layer is rendered tenacious to imrpove cutting property. In addition, when the average crack intervals in the coated layers respectively differ, the smallest average crack interval is acknowledged as the average crack interval of the present invention.

The cracks referred in the present invention include cracks introduced during grinding or mirror-polishing, which crack leangths or crack intervals can be measured by the above described measurement method or a method mentioned in the following Examples.

(c) When, of the cracks in the coated film on the ridge of the cutting edge, those in which the ends of the cracks, at the substrate side, exist in the said innermost titanium nitride layer, in the said titanium carbonitride layer of columnar structure or in an interface between the said titanium nitride layer and the said titanium carbonitride layer of columnar structure exist in a proportion of at least 50%, the proportion of cracks penetrated to the substrate is small so that such a phenomenon can be suppressed that the cemented carbide substrate tends to break or fracture from the cracks penetrated through the substrate, as a stress-concentrated source, during intermittent cutting or the cemented carbide directly below the coated film is broken to peel off the coated film and to lower the wear resistance. In this case, a proportion of at least 80% is particularly preferred. Because of the above described reason, this specifying includes also a case where the ends of the cracks, at the substrate side, exist in the interface between the innermost titanium nitride layer and the substrate and are not penetrated to the substrate.

(d) When the average crack length in the coated film of the said ridge of the cutting edge is shorter than the average coated film thickness of the flank face, the cracks penetrated from the surface to the substrate are decreased and breakage of the cemented carbide substrate due to oxidation of the cemented carbide substrate at the ends of the cracks penetrated through the substrate during cutting at high speed and increase of wearing due to peeling of the film can be suppressed. This is preferred.

When the average crack interval in the coated film on the said ridge of the cutting edge is at most 10 $\mu$m, furthermore, cutting stress loaded at the ridge of the cutting edge can be prevented from concentration on the specified crack ends, that is, the stress can be dispersed, thus improving the breakage resistance, suppressing abnormal abrasion and improving the wear resistance. This is particularly preferable.

In the above described features II, the grounds for specifying (e) will now be illustrated.

(e) At least one of the said alumina layers is removed or polished on at least a part of the ridge of the cutting edge, for example, by a polishing method using a brush carrying or containing abrasive grains or elastic abrasive wheel, barrel treatment method or blast treatment method. These treatments serve to prevent the coated film from peeling and improve the breakage resistance as well as the wear resistance. Partial removal of the alumina layer results in suppressing of an adhesion phenomenen of a workpiece to the cutting edge, hindering of a flow of adhesion→increase of cutting resistance→fracture of the film and supppressing of breakage of the alumina layer and abnormal wearing due to friction of broken alumina grains with the flank face.

The removal method can preferably be carried out in such a manner as extending to the whole ridge of the cutting edge.

Judgment as to whether the alumina layer is removed or not can be carried out by not only observing a tool surface by SEM and photographing a composition image or subjecting to EDS (energy dispersive spectroscopy) but also subjecting a cross-section of an alloy to analysis with an optical microscope, SEM or EDS after polishing or lapping the same.

In the above described features III, the grounds for specifying (e) will now be illustrated.

(e) The said alumina layer is removed or polished on at least a part of the ridge of the cutting edge, for example, by a polishing method using a brush carrying or containing abrasive grains or elastic abrasive wheel, barrel treatment method or blast treatment method. These treatments serve to prevent the coated film from peeling and to improve the breakage resistance as well as the wear resistance. The alumina film is rendered flat by polishing a part of the alumina layer to smoothen a flow of chips, whereby a flow of adhesion→increase of cutting resistance→fracture of the film is hard to be caused, breakage of the alumina layer and abnormal wearing due to friction of broken alumina grains with the flank face can be suppressed.

Figure 4:
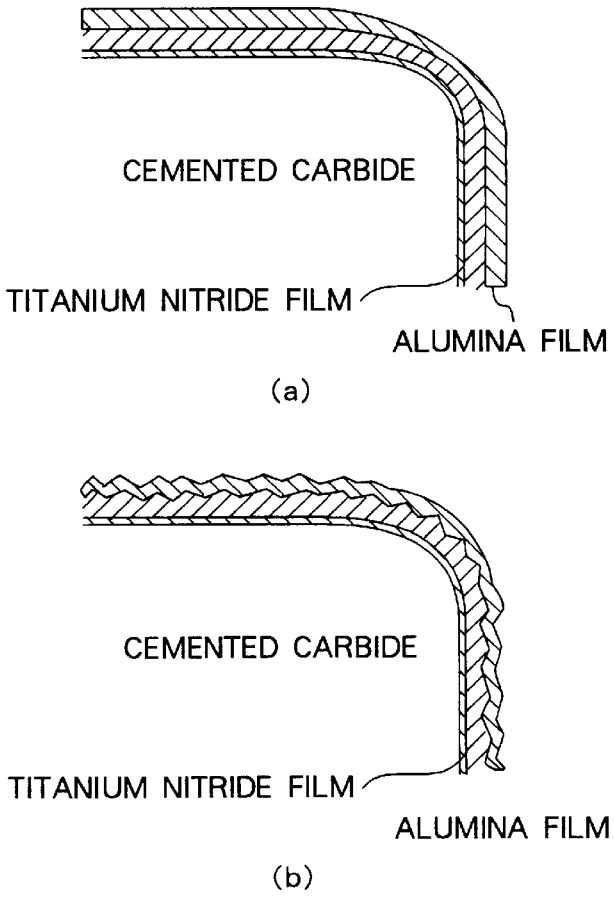
FIG. 4 (*a*) and (*b*) respectively are typical cross-sectional views of polished states of alumina layers on mirror-polished cross-sectional microstructures of inserts according to the present invention.

The removal method can preferably be carried out in such a manner as extending to the whole ridge of the cutting edge. Judgment as to whether there is a polished area on the alumina layer or not can be carried out by observing a tool surface, for example, by SEM to judge whether there are hardly distinguishable parts on grain diameters or grain boundaries or not, whether on a mirror-polished, cross-sectional microstructure, the film thickness of the alumina layer on the ridge of the cutting edge is thinner than the film thickness of the alumina layer on the flank face or rake face or not [Cf. FIG. 4 (a)] or whether on a mirror-polished, cross-sectional microstructure, the roughness of the alumina layer on the ridge of the cutting edge is smaller than the roughness of the alumina film on the flank face or rake face or not [Cf. FIG. 4 (b)].

Moreover, the degree of polishing should preferably be in a range of 5 to 99%, more preferably 30 to 95% of the thickness of the alumina layer.

In the feature (II) of the present invention, when the crack interval in the surface-exposed coated layer A, at which the said alumina layer has been removed, is 0.5 to 5 $\mu$m, in particular, the anti-adhesive property and wear resistance are excellent and the breakage resistance is remarkably improved. This is particularly preferable.

In the feature II of the present invention, when the surface-exposed coated layer A, at which the said alumina layer has been removed, consists of titanium carbonitride layer of columnar structure with an aspect ratio of at least 5, preferably 10 to 50, having a thickness of 3 to 30 $\mu$m, or when at least 50% of the cracks in the coated film on the said ridge of the cutting edge exist on only the said titanium carbonitride layer of columnar structure and are not penetrated through the upper and lower coated layers thereof, the cracks are hardly propagated in parallel to the film surface and hardly integrated with each other even under such a cutting condition that impacts are repeatedly loaded as in intermittent cutting and a rapid wear-increasing phenomenon due to adhesion breakage resulting from chipping of the film and due to peeling of the film can be suppressed, because grain shape of the titanium carbonitride film consisting of the said columnar structure are columnar.

In the coated cemented carbide having the feature II or III according to the present invention, the total thickness of the coatings is preferably in a range of 3 to 50 $\mu$m.

In the feature III of the present invention, when there is the coated layer A having a crack interval of 0.5 to 5 $\mu$m below the said alumina polished layer, in particular, the anti-adhesive property and wear resistance are excellent and the breakage resistance is remarkably improved. Thus, this is preferable.

In the feature III of the present invention, when the coated layer A, existing under the said alumina polished part, consists of titanium carbonitride layer of columnar structure with an aspect ratio of at least 5, preferably 10 to 50, having a thickness of 3 to 30 μm or when at least 50% of the cracks in the coated film on the said ridge of the cutting edge exist on only the said titanium carbonitride layer of columnar structure and is not penetrated through the upper and lower coated layers thereof, the cracks are hardly propagated in parallel to the film surface and hardly integrated with each other even under such a cutting condition that impacts are repeatedly loaded as in intermittent cutting and a rapid wear-increasing phenomenon due to adhesion breakage resulting from chipping of the film and due to peeling of the film can be suppressed, because grain shape of the titanium carbonitride layer consisting of the said columnar structure are columnar.

In the coated cemented carbide having the feature II or III according to the present invention, the total thickness of the coatings is preferably in a range of 3 to 50 μm.

Similarly to the present invention having the feature I, in the feature II or III, when the surface of the said cemented carbide has also a β-free layer (layer having no other precipitates than WC and a binder metal), cracks are hard to be propagated and the breakage resistance can further be improved because of improved toughness on the surface area of the cemented carbide while the cracks are allowed to progress through the substrate by cutting stress. Furthermore, when there is a higher hardness area directly below the β-free layer, than hardness inside the alloy, balance of the breakage resistance and wear resistance is improved. The β-free layer can be obtained by sintering a cemented carbide composition powder containing a nitride and/or carbonitride in a denitrization atmosphere, e.g. in vacuum. Its thickness is preferably 5 to 50 μm.

In the feature II of the present invention, as the removed alumina layer, it is preferable in order to remove uniformly the alumina layer on the ridge of the cutting edge to choose κ-alumina capable of readily forming uniformly fine grains and being also excellent in wear resistance on a flank face during steel cutting.

On the other hand, in the feature III of the present invention, as the said polished alumina layer, it is preferable to choose α-alumina being excellent in strength and less in falling-off of grains during polishing and capable of exhibiting excellent wear resistance on a flank face during cast iron cutting.

According to the fourth feature IV of the present invention, in a coated cemented carbide cutting tool comprising a substrate consisting of a matrix of WC and a binder phase of an iron group metal and a plurality of coated layers provided on a surface of the substrate, (a) an innermost layer, adjacent to the substrate, of the coated layers consists essentially of titanium nitride having a thickness of 0.1 to 3 μm, preferably 0.3 to 1 μm, which is further coated with titanium carbonitride layer of columnar structure with an aspect ratio of at least 5, preferably 10 to 50, having a thickness of 3 to 30 μm, preferably 5 to 15 μm and further coated with at least one alumina layer with a thickness of 0.5 to 10 μm, preferably 1 to 8 μm, and (b) it is importnat that on a mirror-polished cross-sectional microstructure of the said tool, at least 50% of ends of cracks at the surface side in the coated film on the ridge of the cutting edge and/or rake face are not penetrated to the surface of the coated film. (c) At least 50% of the cracks in the coated film on the said ridge of the cutting edge and/or rake face have ends of the cracks, at the substrate side, in the said innermost titanium nitride layer, in a layer above the titanium nitride layer or in an interface between these layers, (d) an average crack length in the coated film on the said ridge of the cutting edge and/or rake face is shorter than an average coated film thickness on the flank face, and (e) an average crack inerval in the said titanium carbonitride layer on the said ridge of the cutting edge and/or rake face is at most 10 μm. In this case, an important element is that (f) an average crack interval in the said alumina layer on the said ridge of the cuttingedge and/or rake face is at least two times as large as an average crack interval in the said titanium carbonitride layer. In the above described fourth feature IV of the present invention, the grounds for specifying (a) to (f) will now be illustrated:

(a) The reason for choosing titanium nitride as the innermost layer consists in that not only the titanium nitride is excellent in adhesive strength to a cemented carbide material, but also is very excellent as a film quality capable of preventing cracks in the coated film from penetration to the substrate. The thickness thereof is specified as above, since if less than 0.1 μm, the effect thereof cannot be expected, while if more than 3 μm, the wear resistance is lowered. The titanium carbonitride layer above it is preferably coated from the standpoint of wear resistance and use of a columnar structure with an aspect ratio of at least 5 results in easy introduction of cracks and formation of a tenacious film itself. When the aspect ratio is in a range of 10 to 50, in particular, excellent properties can be expected. The thickness thereof is specified as described above, since if less than 3 μm, the effect of improving the wear resistance becomes smaller, while if more than 30 μm, the breakage resistance is markedly lowered. The alumina layer above it is necessary from the standpoint of suppressing wear on the rake face when subjecting steels to high speed cutting. If the thickness is less than 0.5 μm, the effect thereof is smaller, while if more than 10 μm, the breakage resistance is markedly lowered.

(b) When, of the cracks in the coated film on the said ridge of the cutting edge and/or rake face, those in which the ends of the cracks, at the surface side, are not penetrated to the surface of the coated film exist in a proportion of at least 50%, a rapid wear-increasing phenomenon due to deterioration of the film quality, breakage of the film and peeling of the film, which are caused by a high temperature generated during high speed cutting and then through oxidation of the coated film, can be suppressed. This is preferable.

(c) When, of the cracks in the coated film on the ridge of the cutting edge and/or rake face, those in which the ends of the cracks, at the substrate side, exist in the said innermost titanium nitride layer, in the said titanium carbonitride layer of columnar structure or in an interface between the said titanium nitride layer and the said titanium carbonitride layer of columnar structure are in a proportion of at least 50%, the proportion of cracks penetrated to the substrate is small so that such a phenomenon can be suppressed that the cemented carbide substrate tends to break or fracture from the cracks penetrated through the substrate, as a stress-concentrated source, during intermittent cutting or the cemented carbide directly below the coated film is broken to peel the coated film and lower the wear resistance. In this case, a proportion of at least 80% is particularly preferred. Because of the above described reason, this specifying includes also a case where the ends of the cracks, at the substrate side, exist in the interface between the innermost titanium nitride layer and the substrate and are not penetrated to the substrate.

(d) When the average crack length in the coated film on the said ridge of the cutting edge and/or rake face is shorter than the average coated film thickness on the flank face, the cracks penetrated from the surface to the substrate are decreased and breakage of the cemented carbide substrate due to oxidation of the cemented carbide substrate at the ends of the cracks penetrated through the substrate during cutting at high speed and increase of wearing due to peeling of the film can be suppressed. This is preferred.

(e) When the average crack interval in the coated film on the said ridge of the cutting edge and/or rake face is at most 10 μm, furthermore, cutting stress loaded at the ridge of the cutting edge can be prevented from concentration on the specified crack ends, that is, the stress can be dispersed, thus improving the breakage resistance, suppressing abnormal wear and improving the wear resistance. This is particularly preferable.

(f) When the average crack interval in the said alumina layer existing outside the said titanium carbonitride layer is at least two times as large as the average crack interval in the said titanium carbonitride layer, deterioration of the film quality due to oxidation of the titanium carbonitride layer during high speed cutting, breakage of the film and wear-increasing phenomenon due to peeling of the film can be suppressed by a mechanical strength improving effect obtained by introducing a number of cracks into the titanium carbonitride layer and and a wider crack interval introduced into the alumina layer, whereby both the breakage resistance and wear resistance can well be satisfied.

In the present invention, the cracks in the coated films on the said ridge of the cutting edge can be introduced in mechanical manner after coating and the coated cemented carbide cutting tool of the present invention can be produced by controling the degree of a mechanical impact. As a means of imparting such a mechanical impact, for example, there are employed, in addition to blasting, methods of polishing by an abrasive grain-adhered brush or elastic grindwheel, by barrel-treating, etc. In the case of carrying out such a treatment for an insert with a hole, for example, there is a tendency of causing differences in cracked states between a coated film on an inner surface in a hole and other coated films on a rake face, ridge of cutting edge and flank face, because the coated film on the inner surface in the hole is hard to be treated.

When the foregoing titanium carbonitride layer of columnar structure is coated by a CVD method comprising using, as a reactant gas, an organo CN compound such as acetonitrile ($CH_3CN$), succinonitrile, tolunitrile, acrylonitrile, butyronitrile or the like at a temperature of 800 to 1000° C., the titanium carbonitride layer tends to be a columnar structure with an aspect ratio of at least 5, into which the cracks of the present invention can readily be introduced. Thus, this method is preferably accepted.

The present invention will now be illustrated in detail without limiting the same.

EXAMPLE 1

A cemented carbide powder with a composition comprising, by weight, 86% WC-3% TaC-1% NbC-2% TiC-1% ZrC-7% Co was pressed, sintered in vacuum at 1400° C. for 1 hour and subjected to a surface grinding treatment and cutting edge treatment to prepare a cemented carbide insert with a Form No. ISO and a shape of CNMG 120408. This insert was coated with the following three kinds of coated films, respetively, in order from the lower layer by a CVD method:

Film Quality ①: 0.5 μm TiC-10 μm TiCN (aspect ratio 3)-0.5 μm TiBN-2 μm α-alumina (total film thickness 13 μm)

Film Quality ②: 0.5 μm TiN-10 μm TiCN (aspect ratio 3)-0.5 μm TiBN-2 μm α-alumina (total film thickness 13 μm)

Film Quality ③: 0.5 μm TiN-10 μm TiCN (aspect ratio 7)-0.5 μm TiBN-2 μm α-alumina (total film thickness 13 μm)

When coating a TiCN layer of Film Quality ③, acetonitrile was used as an organo CN compound and coated at 900° C. to form a TiCN layer of columnar structure with an aspect ratio of about 7. Any film quality was formed using $H_2S$ gas as an additive gas when coating an alumina film in such a manner that the film thickness be uniform on the ridge of the cutting edge and central part of the flank face. In any film quality, accordingly, the coated film thickness was about 13 μm throughout the rake face, ridge of the cutting edge and central part of the flank face.

Furthermore, the surface of this coated cemented carbide was subjected to shot blasting while changing the size, projection speed, projection angle and projection time of the iron ball to prepare insert samples differing in cracked states in the coated films as shown in Table 1. The state of cracks in the coated film was quantified by cutting each sample of the coated cemented carbides by a diamond wheel, burying in a resin in such a manner that the cut surface was well seen, subjecting the cut surface to surface grinding of a thickness of about 300 μm, using Diamond Wheel #140 as a grinding disk under conditions of a grinding speed of 30 m/sec, feed speed of 20 cm/sec, cutting depth of 4 μm (initial stage), 2 μm (middle stage) and 1 μm (latter stage), further to rough polishing by a polishing disk with Diamond Paste #1500 (mean grain diameter 11.5 to 8.9 μm) and then to finish-polishing with Diamond Paste #3000 (mean grain diameter 5.9 to 4.7 μm, JIS R 6001) and observing the finish-polished surface using an optical microscope with a magnification of 1500 times.

TABLE 1

| Sample No. | Coated Film Quality | Crack Interval in Coated Film (μm) X Ridge of Cutting Edge | X Rake Face | Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Within Scope of Present Invention |
|---|---|---|---|---|---|---|---|---|
| 1-1 | ① | 90 | 90 | 90 | 15 | 14 | 13 | |
| 1-2 | ① | 30 | 30 | 90 | 5 | 15 | 13 | |

TABLE 1-continued

| Sample No. | Coated Film Quality | Crack Interval in Coated Film (μm) X Ridge of Cutting Edge | X Rake Face | Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Within Scope of Present Invention |
|---|---|---|---|---|---|---|---|---|
| 1-3 | ① | 8 | 8 | 90 | 2 | 15 | 13 | |
| 1-4 | ② | 90 | 90 | 90 | 30 | 13 | 13 | |
| 1-5 | ② | 30 | 30 | 90 | 40 | 12 | 13 | |
| 1-6 | ② | 30 | 30 | 90 | 80 | 11 | 13 | ○ |
| 1-7 | ③ | 18 | 18 | 18 | 33 | 11 | 13 | |
| 1-8 | ③ | 15 | 12 | 18 | 60 | 9 | 13 | ○ |
| 1-9 | ③ | 9 | 15 | 16 | 71 | 8 | 13 | ○ |
| 1-10 | ③ | 8 | 15 | 17 | 90 | 6 | 13 | ○ |
| 1-11 | ③ | 3 | 8 | 18 | 95 | 5 | 13 | ○ |
| 1-12 | ③ | 5 | 1 | 18 | 98 | 4 | 13 | ○ |
| 1-13 | ③ | 12 | 15 | 20 | 86 | 10 | 13 | ○ |
| 1-14 | ③ | 15 | 15 | 6 | 71 | 7 | 13 | |
| 1-15 | ③ | 8 | 8 | 18 | 40 | 10 | 13 | |
| 1-16 | ③ | 9 | 5 | 18 | 30 | 12 | 13 | |

Figure 5:
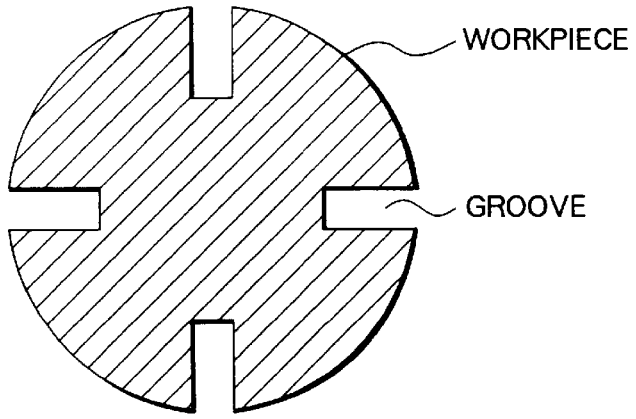
FIG. 5 is a cross-sectional view of a workpiece of SCM 435 (round rod) used for a cutting test in Examples.

Using these inserts, a workpiece of SCM 435, shown in FIG. 5 (round rod provided with four grooves for intermittent cutting), was subjected to cutting under the following conditions to estimate the breakage resistance of each tool sample and Wear Resistance Test 1 was carried out as to a workpiece SCM 435 under the following conditions:

| Fracture Strength Test 1 | |
|---|---|
| Cutting Speed | 150 m/min |
| Feed | 0.4 mm/rev |
| Cutting Depth | 2 mm |
| Cutting Oil | dry process |
| Holder Used | PCLNR 2525-43 |

Judgment of the service life was effected at the time when fracture took place and the life time was measured by four corner average.

| Wear Resistance Test 1 | |
|---|---|
| Cutting Speed | 300 m/min |
| Feed | 0.3 mm/rev |
| Cutting Depth | 1.5 mm |
| Cutting Time | 30 minutes |
| Cutting Oil | wet process |
| Holder Used | PCLNR 2525-43 |

The results are shown in Table 2, from which it is apparent that the inserts of the present invention, Sample Nos. 1-6 and 1-8 to 1-13, in which Film Qualities ② and ③ comprising the lowermost layer consisting of 0.5 μm TiN and, as a layer above it, 10 μm TiCN film of a columnar structure with an aspect ratio of 3 to 7 [capable of satisfying Construction Element (a) of the foregoing Invention (1)] are coated and the state of cracks satisfies Construction Elements (b), (c) and (d) of the foregoing Invention (1), exhibit more excellent breakage resistance and wear resistance, as compared with Sample Nos. 1-1 to 1-3 whose lowermost layer does not consist of TiN and Sample Nos. 1-4, 1-5, 1-7 and 1-14 to 1-16, which consist of Film Qualities ② and ③, but do not satisfy any one of Construction Elements (b), (c) and (d).

Above all, Sample Nos. 1-9 to 1-12 within the scope of the present invention, in which the average crack interval in the coated film on the ridge of the cutting edge is at most 10 μm, in particular, exhibit more excellent breakage resistance and wear resistance.

Furthermore, Sample Nos. 1-10, 1-11 and 1-12 within the scope of the present invention having a value of Y/X of at least 2 (average crack interval X in coated film on ridge of cutting edge and average crack interval Y in coated film on flank face) exhibit particularly excellent breakage resistance and wear resistance.

TABLE 2

| Sample No | Construction Elements Satisfied (a) | (b) | (c) | (d) | Y/X | Breakage Resistance Test 1 Life (sec) | Wear Resistance Test 1 Average Flank Wear Width (mm) | Within Scope of Our Invention |
|---|---|---|---|---|---|---|---|---|
| 1-1 | x | x | x | x | 1 | 2 | 0.34 | |
| 1-2 | x | ○ | x | x | 3 | 5 | 0.35 | |
| 1-3 | x | ○ | x | x | 11.3 | 9 | 0.38 | |
| 1-4 | ○ | x | x | x | 1 | 3 | 0.29 | |
| 1-5 | ○ | ○ | x | ○ | 3 | 8 | 0.22 | |
| 1-6 | ○ | ○ | ○ | ○ | 3 | 29 | 0.21 | ○ |
| 1-7 | ○ | x | x | ○ | 1 | 11 | 0.48 | |
| 1-8 | ○ | ○ | ○ | ○ | 1.5 | 33 | 0.19 | ○ |
| 1-9 | ○ | ○ | ○ | ○ | 1.8 | 45 | 0.19 | ○ |
| 1-10 | ○ | ○ | ○ | ○ | 2.1 | 58 | 0.17 | ○ |
| 1-11 | ○ | ○ | ○ | ○ | 6.0 | 67 | 0.16 | ○ |
| 1-12 | ○ | ○ | ○ | ○ | 18.0 | 75 | 0.17 | ○ |
| 1-13 | ○ | ○ | ○ | ○ | 1.7 | 37 | 0.19 | ○ |
| 1-14 | ○ | x | ○ | ○ | 0.4 | 23 | 0.38 | |
| 1-15 | ○ | ○ | x | ○ | 2.3 | 10 | 0.21 | |
| 1-16 | ○ | ○ | x | ○ | 3.6 | 4 | 0.22 | |

EXAMPLE 2

An insert of the same cemented carbide having a Form No. ISO and a shape of CNMG 120408 as that of Example 1 was prepared. This insert was coated with Coated Film Quality ③ described in Example 1 and subjected to a blasting treatment of the surface of the coated cemented carbide using iron powder of about 100 μm in grain size from the rake face side while changing a projection speed of the iron powder to prepare various inserts differing in cracked state in the coated film, as shown in Table 3. Using these inserts, the same cutting test as that of Example 1 was carreid out.

TABLE 3

| Sample No. | Crack Interval in Coated Film (μm) X Ridge of Cutting Edge | X Rake Face | Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Within Scope of Present Invention |
|---|---|---|---|---|---|---|---|
| 2-1 | 20 | 20 | 30 | 15 | 12 | 13 | |
| 2-2 | 7 | 6 | 30 | 15 | 11 | 13 | |
| 2-3 | 5 | 6 | 30 | 50 | 11 | 13 | ○ |
| 2-4 | 6 | 7 | 30 | 75 | 10 | 13 | ○ |
| 2-5 | 6 | 8 | 30 | 80 | 10 | 13 | ○ |
| 2-6 | 7 | 7 | 30 | 90 | 9 | 13 | ○ |
| 2-7 | 6 | 7 | 30 | 95 | 9 | 13 | ○ |

The results are shown in Table 4. The inserts of Sample Nos. 2-3 to 2-7 within the scope of the present invention all exhibit excellent breakage resistance and wear resistance and above all, Sample Nos. 2-5, 2-6 and 2-7, in which such a proportion that the ends of cracks, at the substrate side, in the coated film on the ridge of the cutting edge are terminated in the innermost titanium nitride layer and titanium carbonitride layer is at least 80%, exhibits particularly excellent breakage resistance as well as wear resistance.

TABLE 4

| Sample No. | Breakage Resistance Test 1 Life (sec) | Wear Resistance Test 1 Average Flank Wear Width (mm) | Within Present Invention |
|---|---|---|---|
| 2-1 | 7 | 0.19 | |
| 2-2 | 9 | 0.20 | |
| 2-3 | 38 | 0.17 | ○ |
| 2-4 | 45 | 0.18 | ○ |
| 2-5 | 62 | 0.17 | ○ |
| 2-6 | 73 | 0.18 | ○ |
| 2-7 | 67 | 0.17 | ○ |

EXAMPLE 3

An insert of the same cemented carbide having a Form No. of ISO and a shape of CNMG 120408 as that of Example 1 was prepared. This insert was then coated with the following Coated Film Quality ④ in order from the lower layer:

Film Quality ④: 1 μm TiN-7 μm TiCN (aspect ratio 5~20)-2 μm TiC-5 μm κ-alumina (total film thickness 15 μm)

The TiCN film was prepared by effecting the coating using acetonitrile, nitrogen gas, $TiCl_4$ and hydrogen gas as a starting gas or carrier gas, while varying the coating temperature within a range of 800 to 1000° C. during the coating and further varying the pressure in a furnace and gas composition to obtain an aspect ratio 5~20. In addition, the flank face of each sample of the resulting tools was masked and then was subjected to a blasting treatment with an iron powder from the rake face side while changing a projection speed of the iron powder to prepare various inserts differing in cracked state in the coated film, as shown in Table 5. Using these inserts, the same cutting test and Wear Resistance Test 2 as those of Example 1 were carreid out.

TABLE 5

| Sample No. | Crack Interval in Coated Film (μm) X Ridge of Cutting Edge | X Rake Face | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Proportion of Cracks not Penetrated to Coated Film Surface (%) | Proportion of Cracks Existing in only TiCN Film (%) | Within Scope of Present Invention |
|---|---|---|---|---|---|---|---|---|---|---|
| 3-1 | 50 | 50 | 50 | 1.0 | 0 | 16.1 | 15 | 0 | 0 | |
| 3-2 | 40 | 40 | 50 | 1.3 | 20 | 15.3 | 15 | 20 | 0 | |
| 3-3 | 25 | 25 | 50 | 2.0 | 50 | 14.0 | 15 | 25 | 0 | ○ |
| 3-4 | 16 | 20 | 50 | 3.1 | 50 | 12.4 | 15 | 40 | 10 | ○ |
| 3-5 | 14 | 12 | 50 | 4.2 | 70 | 8.5 | 15 | 55 | 30 | ○ |
| 3-6 | 14 | 13 | 50 | 3.8 | 70 | 6.4 | 15 | 75 | 40 | ○ |
| 3-7 | 13 | 12 | 50 | 4.2 | 70 | 5.3 | 15 | 75 | 55 | ○ |
| 3-8 | 12 | 12 | 50 | 4.2 | 90 | 4.7 | 15 | 90 | 80 | ○ |
| 3-9 | 5 | 4 | 50 | 12.5 | 90 | 4.8 | 15 | 90 | 90 | ○ |

| Wear Resistance Test 2 | |
|---|---|
| Workpiece | Workpiece of FCD 700 with intermittent shape shown in FIG. 5 |
| Cutting Speed | 200 m/min |
| Feed | 0.3 mm/rev |
| Cutting Depth | 1.5 mm |
| Cutting Time | 10 minutes |
| Cutting Oil | wet process |
| Holder Used | PCLNR 2525-43 |

The results are shown in Table 6. As is evident from this table, the inserts of the present invention, Sample Nos. 3-3 to 3-9 show excellent breakage resistance and wear resistance, but above all, the inserts of Sample Nos. 3-5 to 3-9, in which, of the cracks in the coated film on the ridge of the cutting edge, those having the ends of the cracks, at the coated film surface side, not penetrated to the coated film surface, are in a proportion of at least 50%, show particularly excellent wear resistance in Wear Resistance Test 1 as a high speed cutting test. Moreover, the inserts of Sample Nos. 3-7 to 3-9, in which, of the cracks in the coated film on the ridge of the cutting edge, those existing in only the titanium carbonitride layer of columnar structure and not penetrated to the upper and lower coated layers are in a proportion of at least 50% show excellent performances in Breakage Resistance Test 1 and Wear Resistance Test 2 to give a tendency of film peeling by impacts in an intermittent cutting.

TABLE 6

| Sample No. | Breakage Resistance Test 1 Life (sec) | Wear Resistance Test 1 Average Flank Wear Width (mm) | Wear Resistance Test 2 Average Flank Wear Width (mm) | Within Present Invention |
|---|---|---|---|---|
| 3-1 | 2 | 0.27 | 0.22 | |
| 3-2 | 3 | 0.24 | 0.20 | |
| 3-3 | 21 | 0.23 | 0.21 | ○ |
| 3-4 | 25 | 0.21 | 0.19 | ○ |
| 3-5 | 29 | 0.15 | 0.18 | ○ |
| 3-6 | 32 | 0.16 | 0.17 | ○ |
| 3-7 | 59 | 0.15 | 0.12 | ○ |
| 3-8 | 65 | 0.13 | 0.10 | ○ |
| 3-9 | 73 | 0.13 | 0.09 | ○ |

EXAMPLE 4

A cemented carbide powder with a composition comprising, by weight, 86% WC-1% TaC-1% NbC-3% TiC-2% ZrCN-7% Co was pressed, sintered in vacuum at 1400° C. for 1 hour and subjected to a surface grinding treatment and cutting edge treatment to prepare a cemented carbide insert with a Form No. ISO and a shape of CNMG 120408. When a cross section of this cemented carbide was mirror-polished and its microstructure was observed by an optical miscroscope, it was confirmed that there could be formed a β-free layer of about 25 μm in thickness on the alloy surface and an area with a higher hardness an inside the alloy directly below the β-free layer. This insert and the insert having no β-free layer on the alloy surface, prepared in Example 1, were coated with Film Quality ③ coated in Example 1.

Furthermore, the surface of this coated cemented carbide was subjected to a blasting treatment using an iron ball in an analogous manner to Example 1, while changing the size, projection speed, projection angle and projection time of the iron ball to prepare insert samples differing in cracked states in the coated films as shown in Table 7.

TABLE 7

| Sample No. | β-free Layer Existing in Cemented Carbide Substrate | Crack Interval in Coated Film (μm) X Ridge of Cutting Edge | X Rake Face | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Proportion of Cracks not Penetrated to Coated Film Surface (%) | Proportion of Cracks Existing in only TiCN Film (%) | Within Scope Present Invention |
|---|---|---|---|---|---|---|---|---|---|---|---|
| 4-1 | no | 8 | 8 | 20 | 2.5 | 60 | 7.2 | 13 | 80 | 70 | ○ |
| 4-2 | no | 3 | 4 | 19 | 6.3 | 60 | 8.5 | 13 | 90 | 80 | ○ |
| 4-3 | yes | 8 | 8 | 20 | 2.5 | 60 | 7.2 | 13 | 80 | 70 | ○ |
| 4-4 | yes | 3 | 4 | 19 | 6.3 | 60 | 8.5 | 13 | 90 | 80 | ○ |

Using these inserts, Breakage Resistance Test 1 and Wear Resistance Test 1 were then carried out in an analogous manner to Example 1. The results are shown in Table 8. The inserts of the present invention, i.e. Sample Nos. 4-1 to 4-4 all exhibit excellent breakage resistance as well as wear resistance and above all, Sample Nos. 4-3 and 4-4 each having a β-free layer on the alloy surface show particularly excellent breakage resistance and wear resistance as compared with Sample Nos. 4-1 and 4-2 having no β-free layer.

TABLE 8

| Sample No. | Breakage Resistance Test Life (sec) | Wear Resistance Test 1 Average Flank Wear Width (mm) | Within Present Invention |
|---|---|---|---|
| 4-1 | 72 | 0.17 | ○ |
| 4-2 | 79 | 0.17 | ○ |
| 4-3 | 113 | 0.12 | ○ |
| 4-4 | 125 | 0.12 | ○ |

EXAMPLE 5

The following Film Quality ⑤ was coated onto a surface of the cemented carbide prepared in Example 4. Further, the surface of this coated cemented carbide was polished by the use of a #400 diamond adhered brush from the rake face side while changing the brush revolving speed, brush cutting depth and quantity of a grinding oil, etc. to prepare inserts differing in cracked state in the coated film, as shown in Table 9. Using these inserts, then, the same breakage resistance test as that of Example 1 was carried out and a workpiece SCM 415 was subjected to Wear Resistance Tests 3 and 4 under the following cutting conditions, as shown in Table 10.

Film Quality ⑤: 0.3 μm TiN-0.4 μm TiBN-6 μm α-$Al_2O_3$ -0.3 μm TiCNO-10 μm TiCN (aspect ratio 10)-0.5 μm AlON-1.5 μm κ-$Al_2O_3$ (total film thickness 19 μm)

The results are shown in Table 11. It will be understood from the results of Table 11 that Sample Nos. 5-3 to 5-8 according to the present invention exhibit more excellent wear resistance and breakage resistance as compared with Sample Nos. 5-1 and 5-2.

Above all, Sample Nos. 5-6, 5-7 and 5-8, in which a proportion of cracks existing in only the TiCN film exceeds 50%, exhibited particularly excellent performances in high speed cutting.

TABLE 11

| Sample No. | Breakage Resistance Test Life (sec) | Wear Resistance Test 3 Average Flank Wear Width (mm) | Wear Resistance Test 4 Average Flank Wear Width (mm) | Within Present Invention |
|---|---|---|---|---|
| 5-1 | 2 | 0.35 | 0.22 | |
| 5-2 | 5 | 0.34 | 0.22 | |
| 5-3 | 29 | 0.29 | 0.21 | ○ |
| 5-4 | 33 | 0.27 | 0.15 | ○ |
| 5-5 | 36 | 0.24 | 0.14 | ○ |
| 5-6 | 38 | 0.18 | 0.12 | ○ |
| 5-7 | 51 | 0.15 | 0.13 | ○ |
| 5-8 | 56 | 0.14 | 0.12 | ○ |

EXAMPLE 6

A cemented carbide powder with a composition comprising, by weight, 87% WC-4% TiC-2% ZrC-7% Co was pressed, sintered in vacuum at 1400° C. for 1 hour and subjected to a surface grinding treatment and cutting edge treatment to prepare a cemented carbide insert with a Form No. ISO and a shape of CNMG 120408. This insert was coated with the following three kinds of coated films, respetively, in order from the lower layer by a CVD method:

Film Quality ⑥: 0.3 μm TiC-8 μm TiCN (aspect ratio 3)-0.5 μm TiCNO-1.7 μm κ-alumina-0.5 μm TiN (total film thickness 11 μm)

TABLE 9

| Sample No. | Crack Interval in Coated Film (μm) X Ridge of Cutting Edge | X Rake Face | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Proportion of Cracks not Penetrated to Coated Film Surface (%) | Proportion of Cracks Existing in only TiCN Film (%) | Within Scope of Present Invention |
|---|---|---|---|---|---|---|---|---|---|---|
| 5-1 | 100 | 100 | 100 | 1.0 | 10 | 19.5 | 19 | 0 | 0 | |
| 5-2 | 80 | 90 | 100 | 1.3 | 30 | 17.8 | 19 | 15 | 10 | |
| 5-3 | 60 | 70 | 100 | 1.7 | 55 | 16.8 | 19 | 23 | 18 | ○ |
| 5-4 | 45 | 50 | 100 | 2.2 | 55 | 15.2 | 19 | 42 | 31 | ○ |
| 5-5 | 30 | 30 | 100 | 3.3 | 75 | 10.3 | 19 | 56 | 42 | ○ |
| 5-6 | 15 | 15 | 100 | 6.7 | 75 | 9.5 | 19 | 73 | 63 | ○ |
| 5-7 | 6 | 6 | 100 | 16.7 | 90 | 7.2 | 19 | 81 | 74 | ○ |
| 5-8 | 6 | 6 | 100 | 16.7 | 90 | 7.0 | 19 | 90 | 80 | ○ |

TABLE 10

| | Wear Resistance Test 3 (high speed cutting) | Wear Resistance Test 4 (low speed cutting) |
|---|---|---|
| Cutting Speed | 500 m/min | 150 m/min |
| Feed | 0.3 mm/rev | 0.3 mm/rev |
| Cutting Depth | 1.5 mm | 1.5 mm |
| Cutting Time | 10 minutes | 60 minutes |
| Cutting Oil | dry process | wet process |
| Holder Used | PCLNR 2525-43 | PCLNR 2525-43 |

Film Quality ⑦: 0.3 μm TiN-8 μm TiCN (aspect ratio 3)-0.5 μm TiCNO-1.7 μm κ-alumina-0.5 μm TiN (total film thickness 11 μm)

Film Quality ⑧: 0.3 μm TiN-8 μm TiCN (aspect ratio 7)-0.5 μm TiCNO-1.7 μm κ-alumina-0.5 μm TiN (total film thickness 11 μm)

When coating a TiCN layer of Film Quality ⑧, acetonitrile was used as an organo CN compound and coated at 900° C. to form a TiCN layer of columnar structure with an aspect ratio of about 7. Any film quality was formed using $H_2S$ gas as an additive gas when coating an alumina film in such a manner that the film thickness be uniform on the ridge of the cutting edge and central part of the flank face. In any film quality, accordingly, the coated film thickness was about 10 μm throughout the rake face, ridge of the cutting edge and central part of the flank face.

Furthermore, the surface of this coated cemented carbide was subjected to a blasting treatment while changing the size and projection speed of the iron ball to prepare insert samples differing in cracked states in the coated films as shown in Table 12. The state of cracks in the coated film was quantified by cutting each sample of the coated cemented carbides by a diamond wheel, burying in a resin in such a manner that the cut surface was well seen, subjecting the cut surface to surface grinding of a thickness of about 300 μm, using Diamond Wheel #140 as a grinding disk under conditions of a grinding speed of 30 m/sec, feed speed of 20 cm/sec, cutting depth of 4 μm (initial stage), 2 μm (middle stage) and 1 μm (latter stage), further to rough polishing by a polishing disk with Diamond Paste #1500 and then to finish-polishing with Diamond Paste #3000 and observing the finish-polished surface using an optical microscope with a magnification of 1500 times.

TABLE 12

| Sample No. | Coated Film Quality | Crack Interval in Coated Film (μm) X Ridge of Cutting Edge | Crack Interval in Coated Film (μm) Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Removal of Alumina Layer on Ridge of Cutting Edge | Within Scope of Present Invention |
|---|---|---|---|---|---|---|---|---|
| 6-1 | 6 | 90 | 90 | 10 | 12 | 11 | no | |
| 6-2 | 6 | 30 | 90 | 5 | 12 | 11 | no | |
| 6-3 | 6 | 10 | 90 | 0 | 12 | 11 | yes | |
| 6-4 | 7 | 90 | 90 | 30 | 12 | 11 | no | |
| 6-5 | 7 | 30 | 90 | 40 | 11 | 11 | no | |
| 6-6 | 7 | 30 | 90 | 60 | 7 | 11 | yes | ○ |
| 6-7 | 8 | 30 | 30 | 30 | 12 | 11 | no | |
| 6-8 | 8 | 15 | 30 | 40 | 8 | 11 | no | |
| 6-9 | 8 | 10 | 30 | 60 | 7 | 11 | no | ○ |
| 6-10 | 8 | 5 | 30 | 75 | 7 | 11 | yes | ○ |
| 6-11 | 8 | 2 | 30 | 80 | 7 | 11 | yes | ○ |
| 6-12 | 8 | 15 | 30 | 40 | 7 | 11 | yes | |
| 6-13 | 8 | 30 | 15 | 30 | 12 | 11 | yes | |
| 6-14 | 8 | 10 | 30 | 70 | 7 | 11 | yes | ○ |
| 6-15 | 8 | 15 | 30 | 40 | 8 | 11 | no | |
| 6-16 | 8 | 10 | 30 | 40 | 7 | 11 | yes | |

Using these inserts, a workpiece of SCM 435, shown in FIG. 5 (round rod provided with four grooves for intermittent cutting), was subjected to cutting under the following conditions to estimate the breakage resistance of each tool sample and Wear Resistance Test 5 was carried out as to a workpiece SCM 435 under the following conditions:

| Breakage Resistance Test 2 | |
|---|---|
| Cutting Speed | 100 m/min |
| Feed | 0.3 mm/rev |
| Cutting Depth | 2 mm |
| Cutting Oil | dry process |
| Holder Used | PCLNR 2525-43 |

Judgment of the service life was effected at the time when fracture took place and the life time was measured by four corner average.

| Wear Resistance Test 5 | |
|---|---|
| Cutting Speed | 260 m/min |
| Feed | 0.35 mm/rev |
| Cutting Depth | 1.5 mm |
| Cutting Time | 30 minutes |
| Cutting Oil | wet process |
| Holder Used | PCLNR 2525-43 |

The results are shown in Table 13, from which it is apparent that the inserts of the present invention, Sample Nos. 6-6, 6-10, 6-11 and 6-14, in which Film Qualities 7 and 8 comprising the lowermost layer consisting of 0.3 μm TiN and, as a layer above it, 8 μm TiCN layer of columnar structure with an aspect ratio of 3 to 7 [capable of satisfying Construction Element (a) of the foregoing Invention (14)] are coated and Construction Elements (b), (c), (d) and (e) of the foregoing Invention (14) are satisfied, exhibit more excellent breakage resistance and wear resistance, as compared with Sample Nos. 6-1 to 6-3 whose lowermost layer does not consist of TiN and Sample Nos. 6-4, 6-5, 6-7, 6-8, 6-9, 6-12, 6-13, 6-15 and 6-16, which consist of Film Qualities 7 and 8, but do not satisfy any one of Construction Elements (b), (c), (d) and (e).

Above all, Sample Nos. 6-10, 6-11 and 6-14, in which the average crack interval in the coated film on the ridge of the cutting edge is at most 10 μm, in particular, exhibit more excellent breakage resistance and wear resistance.

Furthermore, Sample Nos. 6-10 and 6-11 each having a value of Y/X of at least 5 (average crack interval X in coated film on ridge of the cutting edge and average crack interval Y in coated film on flank face) exhibit particularly excellent breakage resistance and wear resistance.

TABLE 13

| Sample No. | Construction Elements Satisfied (a) | (b) | (c) | (d) | (e) | Y/X | Breakage Resistance Test 2 Life (sec) | Wear Resistance Test 5 Average Flank Wear Width (mm) | Within Scope of Our Invention |
|---|---|---|---|---|---|---|---|---|---|
| 6-1 | x | x | x | x | x | 1 | 2 | 0.41 | |
| 6-2 | x | ○ | x | x | x | 3 | 3 | 0.45 | |
| 6-3 | x | ○ | x | x | ○ | 9 | 10 | 0.36 | |
| 6-4 | ○ | x | x | x | x | 1 | 3 | 0.34 | |
| 6-5 | ○ | ○ | x | x | x | 3 | 17 | 0.38 | |
| 6-6 | ○ | ○ | ○ | ○ | ○ | 3 | 75 | 0.27 | ○ |
| 6-7 | ○ | x | x | x | x | 1 | 8 | 0.29 | |
| 6-8 | ○ | ○ | x | ○ | x | 2 | 25 | 0.28 | |
| 6-9 | ○ | ○ | ○ | ○ | x | 3 | 34 | 0.23 | |
| 6-10 | ○ | ○ | ○ | ○ | ○ | 6 | 105 | 0.19 | ○ |
| 6-11 | ○ | ○ | ○ | ○ | ○ | 15 | 121 | 0.18 | ○ |
| 6-12 | ○ | ○ | x | ○ | ○ | 2 | 38 | 0.28 | |
| 6-13 | ○ | x | x | x | ○ | 0.5 | 12 | 0.37 | |
| 6-14 | ○ | ○ | ○ | ○ | ○ | 3 | 96 | 0.21 | ○ |
| 6-15 | ○ | ○ | x | ○ | x | 2 | 23 | 0.30 | |
| 6-16 | ○ | ○ | x | ○ | ○ | 3 | 29 | 0.27 | |

EXAMPLE 7

An insert of the same cemented carbide having a Form No. ISO and a shape of CNMG 120408 as that of Example 6 was prepared. This insert was coated with Coated Film Quality ⑧ described in Example 6 and subjected to a surface treatment of the surface of the coated cemented carbide using a nylon brush, in which #800 diamond abrasives was buried, from the rake face side in such a manner as removing the alumina layer on at least a part of the ridge of the cutting edge to prepare various inserts differing in cracked state in the coated film, as shown in Table 14. Using these inserts, the same cutting test as in Example 6 was carreid out.

TABLE 14

| Sample No. | Crack Interval in Coated Film (μm) X: Ridge of Cutting Edge | Y: Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Within Scope of Present Invention |
|---|---|---|---|---|---|---|
| 7-1 | 20 | 30 | 25 | 11 | 11 | |
| 7-2 | 16 | 30 | 40 | 10 | 11 | |
| 7-3 | 13 | 30 | 50 | 9 | 11 | ○ |
| 7-4 | 11 | 30 | 60 | 8 | 11 | ○ |
| 7-5 | 8 | 30 | 70 | 7 | 11 | ○ |
| 7-6 | 5 | 30 | 80 | 6 | 11 | ○ |
| 7-7 | 3 | 30 | 90 | 6 | 11 | ○ |

The results are shown in Table 15. The inserts of Sample Nos. 7-3 to 7-7 within the scope of the present invention all exhibit excellent breakage resistance and wear resistance and above all, Sample Nos. 7-6 and 7-7, in which such a proportion that the ends of cracks, at the substrate side, in the coated film on the ridge of the cutting edge are terminated in the innermost titanium nitride layer, in the titanium carbonitride layer or in an interface between the both is at least 80%, exhibit particularly excellent breakage resistance as well as wear resistance.

TABLE 15

| Sample No. | Breakage Resistance Test 2 Life (sec) | Wear Resistance Test 5 Average Flank Wear Width (mm) | Within Present Invention |
|---|---|---|---|
| 7-1 | 12 | 0.24 | |
| 7-2 | 19 | 0.24 | |
| 7-3 | 68 | 0.21 | ○ |
| 7-4 | 74 | 0.20 | ○ |
| 7-5 | 82 | 0.19 | ○ |
| 7-6 | 107 | 0.19 | ○ |
| 7-7 | 119 | 0.18 | ○ |

EXAMPLE 8

An insert of the same cemented carbide having a Form No. of ISO and a shape of CNMG 120408 as that of Example 6 was prepared. This insert was then coated with the following Coated Film Quality ⑨ in order from the lower layer:

Film Quality ⑨ 1 μm TiN-7 μm TiCN-3 μm TiC-2 μm α-alumina

The TiCN layer was prepared by effecting the coating using acetonitrile, nitrogen gas, $TiCl_4$ and hydrogen gas as a starting gas or carrier gas, while varying the coating temperature within a range of 800 to 1000° C. during the coating and further varying the pressure in a furnace and gas composition to obtain an aspect ratio of 5~20. In addition, the surface of each sample of the resulting inserts was subjected to a surface treatment from the rake face with an elastic grindwheel, in which SiC abrasive grains of #1200 were buried, to prepare various inserts differing in cracked state in the coated film, as shown in Table 16. Using these inserts, the same cutting test and Wear Resistance Test 6 as in Example 6 were carreid out.

TABLE 16

| Sample No | Crack Interval in Coated Film (μm) X Ridge of Cutting Edge | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) |
|---|---|---|---|---|---|
| 8-1 | 60 | 60 | 1 | 10 | 15 |
| 8-2 | 20 | 60 | 3 | 40 | 12 |
| 8-3 | 15 | 60 | 4 | 50 | 9 |
| 8-4 | 6 | 60 | 10 | 60 | 6 |
| 8-5 | 3 | 60 | 20 | 80 | 5 |
| 8-6 | 1 | 60 | 60 | 90 | 4 |
| 8-7 | 0.5 | 60 | 120 | 95 | 4 |

| Sample No | Average Coated Film Thickness on Flank Face (μm) | Removal of Alumina Layer on Ridge of Cutting Edge | Crack Interval in Coated Layer A (μm) | Aspect Ratio and Film Quality in Coated Layer A (μm) | Proportion of Cracks Existing in only TiCN Film (%) | Within Scope of Present Invention |
|---|---|---|---|---|---|---|
| 8-1 | 13 | no | — | — | | |
| 8-2 | 13 | no | — | — | | |
| 8-3 | 13 | yes | 25 | 3 TiC | 10 | ○ |
| 8-4 | 13 | yes | 6 | 5 TiCN | 60 | ○ |
| 8-5 | 13 | yes | 3 | 15 TiCN | 70 | ○ |
| 8-6 | 13 | yes | 1 | 30 TiCN | 80 | ○ |
| 8-7 | 13 | yes | 0.5 | 50 TiCN | 90 | ○ |

| Wear Resistance Test 6 | |
|---|---|
| Workpiece | Workpiece of FCD 700 with intermittent shape shown in FIG. 5 |
| Cutting Speed | 150 m/min |
| Feed | 0.35 mm/rev |
| Cutting Depth | 1.5 mm |
| Cutting Time | 10 minutes |
| Cutting Oil | wet process |
| Holder Used | PCLNR 2525-43 |

The results are shown in Table 17. As is evident from this table, the inserts of the present invention, Sample Nos. 8-3 to 8-7 all show excellent breakage resistance and wear resistance, but above all, the inserts of Sample Nos. 8-4 to 8-7, in which the surface-exposed coated layer A in an area where the said alumina layer has been removed consists of titanium carbonitride layer of columnar structure with an aspect ratio of at least 5, having a thickness of 3 to 30 μm, show more excellent performances in Breakage Resistance Test 2 and Wear Resistance Test 6 to give a tendency of film peeling by impacts in an intermittent cutting. The inserts of Sample Nos. 8-5 to 8-7, in which the crack intervals in the coated layer A are in a range of 0.5 to 5 μm, show particularly excellent breakage resistance and wear resistance

TABLE 17

| Sample No. | Breakage Resistance Test 2 Life (sec) | Wear Resistance Test 5 Average Flank Wear Width (mm) | Wear Resistance Test 6 Average Flank Wear Width (mm) | Within Present Invention |
|---|---|---|---|---|
| 8-1 | 2 | 0.29 | 0.24 | |
| 8-2 | 15 | 0.25 | 0.21 | |
| 8-3 | 63 | 0.20 | 0.18 | ○ |
| 8-4 | 97 | 0.18 | 0.10 | ○ |
| 8-5 | 146 | 0.17 | 0.08 | ○ |
| 8-6 | 159 | 0.19 | 0.08 | ○ |
| 8-7 | 132 | 0.23 | 0.09 | ○ |

EXAMPLE 9

A cemented carbide powder with a composition comprising, by weight, 87% WC-4% TiC-2% ZrCN-7% Co was pressed, sintered in vacuum at 1400° C. for 1 hour and subjected to a surface grinding treatment and cutting edge treatment to prepare a cemented carbide insert with a Form No. ISO and a shape of CNMG 120408. When a cross section of this cemented carbide was mirror-polished and its microstructure was observed by an optical miscroscope, it was confirmed that there could be formed a β-free layer of about 25 μm on the alloy surface and an area with a higher hardness than inside the alloy directly below the β-free layer by measurement of a cross-sectional hardness distribution. This insert and the insert having no β-free layer on the alloy surface, prepared in Example 6, were coated with the coated film, coated in Example 8.

Furthermore, the surface of this coated cemented carbide was subjected to a blasting treatment using an iron ball in an analogous manner to Example 6, while changing the size, projection speed, projection angle and projection time of the iron ball to prepare insert samples differing in cracked states in the coated films as shown in Table 18.

TABLE 18

| Sample No. | β-free Layer Existing in Cemented Carbide Substrate | Crack Interval in Coated Film (μm) X Ridge of Cutting Edge | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) |
|---|---|---|---|---|---|---|
| 9-1 | no | 8 | 60 | 7.5 | 70 | 7 |
| 9-2 | no | 3 | 60 | 20 | 90 | 5 |
| 9-3 | no | 3 | 60 | 20 | 90 | 5 |
| 9-4 | yes | 8 | 60 | 7.5 | 70 | 7 |
| 9-5 | yes | 3 | 60 | 20 | 90 | 5 |
| 9-6 | yes | 3 | 60 | 20 | 90 | 5 |

| Sample No. | Average Coated Film Thickness on Flank Face (μm) | Removal of Alumina Layer on Ridge of Cutting Edge | Crack Interval in Coated Layer A (μm) | Aspect Ratio and Film Quality in Coated Layer A (μm) | Proportion of Cracks Existing in only TiCN Film (%) | Within Scope of Present Invention |
|---|---|---|---|---|---|---|
| 9-1 | 13 | yes | 8 | 15 TiCN | 30 | ○ |
| 9-2 | 13 | yes | 3 | 15 TiCN | 50 | ○ |
| 9-3 | 13 | yes | 3 | 15 TiCN | 75 | ○ |
| 9-4 | 13 | yes | 8 | 15 TiCN | 30 | ○ |
| 9-5 | 13 | yes | 3 | 15 TiCN | 50 | ○ |
| 9-6 | 13 | yes | 3 | 15 TiCN | 75 | ○ |

Using these inserts, Breakage Resistance Test 2 and Wear Resistance Tests 5 and 6 were then carried out in an analogous manner to Example 6 and 8. The results are shown in Table 19. The inserts of the present invention, Sample Nos. 9-1 to 9-6 all exhibit excellent breakage resistance as well as wear resistance and above all, Sample Nos. 9-4 and 9-6 each having a β-free layer on the alloy surface show more excellent breakage resistance and wear resistance as compared with Sample Nos. 9-1 to 9-3 having no β-free layer. It is confirmed that above all, the inserts of Sample Nos. 9-5 and 9-6 in which the proportion of cracks existing in only the TiCN layer of columnar structure is at least 50% have particularly excellent breakage resistance and wear resistance.

TABLE 19

| Sample No. | Breakage Resistance Test 2 Life (sec) | Wear Resistance Test 5 Average Flank Wear Width (mm) | Wear Resistance Test 6 Average Flank Wear Width (mm) | Within Present Invention |
|---|---|---|---|---|
| 9-1 | 110 | 0.21 | 0.11 | ○ |
| 9-2 | 148 | 0.18 | 0.07 | ○ |
| 9-3 | 162 | 0.17 | 0.06 | ○ |
| 9-4 | 156 | 0.15 | 0.11 | ○ |
| 9-5 | 213 | 0.13 | 0.08 | ○ |
| 9-6 | 237 | 0.12 | 0.06 | ○ |

EXAMPLE 10

A cemented carbide powder with a composition comprising, by weight, 90% WC-3% TiC-1% ZrC-6% Co was pressed, sintered in vacuum at 1400° C. for 1 hour and subjected to a surface-grinding treatment and cutting edge treatment to prepare a cemented carbide insert with a Form No. ISO and a shape of CNMG 120408. This insert was coated with the following three kinds of coated films, respetively, in order from the lower layer by a CVD method:

Film Quality ⑩: 0.3 μm TiC-5.7 μm TiCN (aspect ratio 3)-0.5 μm TiCNO-4 μm α-alumina-0.5 μm TiN (total film thickness 11 μm)

Film Quality ⑪: 0.3 μm TiN-5.7 μm TiCN (aspect ratio 3)-0.5 μm TiCNO-4 μm α-alumina-0.5 μm TiN (total film thickness 11 μm)

Film Quality ⑫: 0.3 μm TiN-5.7 μm TiCN (aspect ratio 7)-0.5 μm TiCNO-4 μm α-alumina-0.5 μm TiN (total film thickness 11 μm)

When coating a TICN layer of Film Quality ⑫, acetonitrile was used as an organo CN compound and coated at 900° C. to form a TiCN layer of columnar structure with an aspect ratio of about 7. Any film quality was formed using $H_2S$ gas as an additive gas when coating an alumina film in such a manner that the film thickness be uniform on the ridge of the cutting edge and central part of the flank face. In any film quality, accordingly, the coated film thickness was about 11 μm throughout the rake face, ridge of the cutting edge and central part of the flank face.

Furthermore, the surface of this coated cemented carbide was subjected to a blasting treatment while changing the size and projection speed to prepare insert samples differing in cracked states in the coated films as shown in Table 20. The state of cracks in the coated film was quantified by cutting each sample of the coated cemented carbides by a diamond wheel, burying in a resin in such a manner that the cut surface was well seen, subjecting the cut surface to surface grinding of a thickness of about 300 μm, using Diamond Wheel #140 as a grinding disk under conditions of a grinding speed of 30 m/sec, feed speed of 20 cm/sec, cutting depth of 4 μm (initial stage), 2 μm (middle stage) and 1 μm (latter stage), further to rough polishing by a polishing disk with Diamond Paste #1500 and then to finish-polishing with Diamond Paste #3000 and observing the finish-polished surface using an optical microscope with a magnification of 1500 times. Presence or absence of the polishing of the $Al_2O_3$ layer is judged by observing the coated film on the ridge of the cutting edge and central part of the flank face by SEM and regarding as the presence of "polishing" when the grain diameter or grain boundary of alumina on the ridge of the cutting edge is hard to be discriminated.

TABLE 20

| Sample No. | Coated Film Quality | Crack Interval in Coated Film (μm) X Ridge of Cutting Edge | Crack Interval in Coated Film (μm) Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | Polishing of Alumina Layer on Ridge of Cutting Edge | Within Scope of Present Invention |
|---|---|---|---|---|---|---|---|---|
| 10-1 | 10 | 100 | 100 | 15 | 12 | 11 | no | |
| 10-2 | 10 | 50 | 100 | 5 | 12 | 11 | no | |
| 10-3 | 10 | 20 | 100 | 0 | 12 | 11 | yes | |
| 10-4 | 11 | 100 | 100 | 35 | 12 | 11 | no | |
| 10-5 | 11 | 40 | 100 | 40 | 11 | 11 | no | |
| 10-6 | 11 | 40 | 100 | 50 | 4 | 11 | yes | ○ |
| 10-7 | 12 | 40 | 40 | 35 | 12 | 11 | no | |
| 10-8 | 12 | 20 | 40 | 40 | 5 | 11 | no | |
| 10-9 | 12 | 15 | 40 | 60 | 4 | 11 | no | ○ |
| 10-10 | 12 | 4 | 40 | 75 | 4 | 11 | yes | ○ |
| 10-11 | 12 | 1 | 40 | 80 | 4 | 11 | yes | ○ |
| 10-12 | 12 | 15 | 40 | 40 | 4 | 11 | yes | |
| 10-13 | 12 | 40 | 20 | 40 | 12 | 11 | yes | |
| 10-14 | 12 | 9 | 40 | 80 | 4 | 11 | yes | ○ |
| 10-15 | 12 | 20 | 40 | 45 | 5 | 11 | no | |
| 10-16 | 12 | 15 | 40 | 40 | 4 | 11 | yes | |

Using these inserts, a workpiece of SCM 435, shown in FIG. 5 (round rod provided with four grooves for intermittent cutting), was subjected to cutting under the following conditions to estimate the breakage resistance of each tool sample and Wear Resistance Test 7 was carried out as to a workpiece SCM 435 under the following conditions:

| Breakage Resistance Test 3 | |
|---|---|
| Cutting Speed | 150 m/min |
| Feed | 0.3 mm/rev |
| Cutting Depth | 2 mm |
| Cutting Oil | dry process |
| Holder Used | PCLNR 2525-43 |

Judgment of the service life was effected at the time when fracture took place and the life time was measured by four corner average.

| Wear Resistance Test 7 | |
|---|---|
| Cutting Speed | 250 m/min |
| Feed | 0.3 mm/rev |
| Cutting Depth | 1.5 mm |
| Cutting Time | 30 minutes |
| Cutting Oil | wet process |
| Holder Used | PCLNR 2525-43 |

The results are shown in Table 21, from which it is apparent that the inserts of the present invention, Sample Nos. 10-6, 10-10, 10-11 and 10-14, in which Film Qualities 11 and 12 comprising the lowermost layer consisting of 0.3 μm TiN and, as a layer above it, 5 μm TiCN layer of a columnar structure with an aspect ratio of 3 to 7 [capable of satisfying Construction Element (a) of the foregoing Invention (14)] are coated and Construction Elements (b), (c), (d) and (e) of the foregoing Invention (14) are satisfied, exhibit more excellent breakage resistance and wear resistance, as compared with Sample Nos. 10-1 to 10-3, whose lowermost layer does not consist of TiN, and Sample Nos. 10-4, 10-5, 10-7, 10-8, 10-9, 10-12, 10-13, 10-15 and 10-16, which consist of Film Qualities 11 and 12, but do not satisfy any one of Construction Elements (b), (c), (d) and (e).

Above all, Sample Nos. 10-10, 10-11 and 10-14, in which the average crack interval in the coated film on the ridge of the cutting edge is at most 10 μm, in particular, exhibit more excellent breakage resistance and wear resistance.

Furthermore, Sample Nos. 10-10 and 10-11 having a value of Y/X of at least 5 (average crack interval X in coated film on ridge of the cutting edge and average crack interval Y in coated film on flank face) exhibit prticularly excellent breakage resistance and wear resistance.

TABLE 21

| Sample No. | Construction Elements Satisfied (a) | (b) | (c) | (d) | (e) | Y/X | Breakage Resistance Test 3 Life (sec) | Wear Resistance Test 7 Average Flank Wear Width (mm) | Within Scope of Our Invention |
|---|---|---|---|---|---|---|---|---|---|
| 10-1 | x | x | x | x | x | 1 | 3 | 0.38 | |
| 10-2 | x | ○ | x | x | x | 2 | 4 | 0.41 | |
| 10-3 | x | ○ | x | x | ○ | 5 | 11 | 0.34 | |
| 10-4 | ○ | x | x | x | x | 1 | 5 | 0.32 | |
| 10-5 | ○ | ○ | x | x | x | 2.5 | 21 | 0.36 | |
| 10-6 | ○ | ○ | ○ | ○ | ○ | 2.5 | 78 | 0.25 | ○ |
| 10-7 | ○ | x | x | x | x | 1 | 9 | 0.29 | |
| 10-8 | ○ | ○ | x | ○ | x | 2 | 30 | 0.26 | |
| 10-9 | ○ | ○ | ○ | ○ | x | 2.7 | 37 | 0.22 | |
| 10-10 | ○ | ○ | ○ | ○ | ○ | 10 | 110 | 0.18 | ○ |
| 10-11 | ○ | ○ | ○ | ○ | ○ | 40 | 132 | 0.17 | ○ |
| 10-12 | ○ | ○ | x | ○ | ○ | 2.7 | 39 | 0.28 | |
| 10-13 | ○ | x | x | x | ○ | 0.5 | 14 | 0.35 | |
| 10-14 | ○ | ○ | ○ | ○ | ○ | 4.4 | 103 | 0.19 | ○ |
| 10-15 | ○ | ○ | x | ○ | x | 2 | 25 | 0.28 | |
| 10-16 | ○ | ○ | x | ○ | ○ | 2.7 | 31 | 0.26 | |

EXAMPLE 11

An insert of the same cemented carbide having a Form No. ISO and a shape of CNMG 120408 as that of Example 10 was prepared. This insert was coated with Coated Film Quality ⑫ described in Example 10 and subjected to a surface treatment of the surface of the coated cemented carbide using a nylon brush, in which #800 diamond abrasives was buried, from the rake face side in such a manner as polishing the alumina layer, while changing the rotating speed of the brush, brush cutting depth, quantity of a grinding oil, etc. to prepare various inserts differing in cracked state in the coated film, as shown in Table 22. Using these inserts, the same cutting test as in Example 10 was carreid out.

TABLE 22

| Sample No. | Crack Interval in Coated Film (μm) X Ridge of Cutting Edge | Y Flank Face | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) | Average Coated Film Thickness on Flank Face (μm) | $Al_2O_3$ Layer Thickness on Ridge of Cutting Edge (μm) | Within Scope of Present Invention |
|---|---|---|---|---|---|---|---|
| 11-1 | 20 | 40 | 24 | 11 | 11 | 3.8 | |
| 11-2 | 17 | 40 | 38 | 10 | 11 | 2.3 | |
| 11-3 | 15 | 40 | 52 | 10 | 11 | 2.2 | ○ |
| 11-4 | 11 | 40 | 65 | 9 | 11 | 2.5 | ○ |
| 11-5 | 9 | 40 | 72 | 8 | 11 | 2.3 | ○ |
| 11-6 | 6 | 40 | 81 | 7 | 11 | 2.4 | ○ |
| 11-7 | 3 | 40 | 95 | 6 | 11 | 2.3 | ○ |

The results are shown in Table 23. The inserts of Sample Nos. 11-3 to 11-7 within the scope of the present invention all exhibit excellent breakage resistance and wear resistance and above all, Sample Nos. 11-6 and 11-7, in which such a proportion that the ends of cracks, at the substrate side, in the coated film on the ridge of the cutting edge are terminated in the innermost titanium nitride layer, in the titanium carbonitride layer or in an interface between the both is at least 80%, exhibit particularly excellent breakage resistance as well as wear resistance.

TABLE 23

| Sample No. | Breakage Resistance Test 3 Life (sec) | Wear Resistance Test 7 Average Flank Wear Width (mm) | Within Present Invention |
|---|---|---|---|
| 11-1 | 15 | 0.22 | |
| 11-2 | 20 | 0.23 | |
| 11-3 | 75 | 0.19 | ○ |
| 11-4 | 80 | 0.18 | ○ |
| 11-5 | 91 | 0.18 | ○ |
| 11-6 | 123 | 0.17 | ○ |
| 11-7 | 131 | 0.17 | ○ |

EXAMPLE 12

An insert of the same cemented carbide having a Form No. of ISO and a shape of CNMG 120408 as that of Example 10 was prepared. This insert was then coated with the following Coated Film Quality ⑬ in order from the lower layer:

Film Quality ⑬ 1 μm TiN-4.5 μm TiCN-0.5 μm TiC-7 μm κ-alumina

The TiCN layer was prepared by effecting the coating using acetonitrile, nitrogen gas, $TiCl_4$ and hydrogen gas as a starting gas or carrier gas, while varying the coating temperature within a range of 800 to 1000° C. during the coating and further varying the pressure in a furnace and gas composition to obtain an aspect ratio of 5~20. In addition, the surface of each sample of the resulting inserts was subjected to a surface treatment from the rake face with an elastic grindwheel, in which SiC abrasive grains of #1200 were buried, to prepare various inserts differing in cracked state in the coated film, as shown in Table 24. Using these inserts, the same cutting test and Wear Resistance Test 8 as in Example 10 were carreid out.

TABLE 24

| Sample No. | Crack Interval in Coated Film (μm) X Ridge of Cutting Edge | Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) |
|---|---|---|---|---|---|
| 12-1 | 80 | 80 | 1 | 15 | 14 |
| 12-2 | 30 | 80 | 2.7 | 35 | 12 |
| 12-3 | 20 | 80 | 4 | 53 | 10 |
| 12-4 | 10 | 80 | 8 | 62 | 4.5 |
| 12-5 | 5 | 80 | 16 | 75 | 3.9 |
| 12-6 | 2 | 80 | 40 | 83 | 3.2 |
| 12-7 | 0.5 | 80 | 160 | 90 | 2.8 |

| Sample No. | Average Coated Film Thickness on Flank Face (μm) | Polishing of Alumina Layer on Ridge of Cutting Edge | Crack Interval in Coated Layer A (μm) | Aspect Ratio and Film Quality in Coated Layer A (μm) | Proportion of Cracks Existing in only TiCN Film (%) | Alumina Layer Thickness on Ridge of Cutting Edge (μm) | Within Scope of Present Invention |
|---|---|---|---|---|---|---|---|
| 12-1 | 13 | no | 80 | 3 TiCN | 5 | 7.0 | |
| 12-2 | 13 | no | 30 | 3 TiCN | 5 | 4.0 | |
| 12-3 | 13 | yes | 20 | 3 TiCN | 20 | 4.2 | ○ |
| 12-4 | 13 | yes | 10 | 5 TiCN | 50 | 4.5 | ○ |
| 12-5 | 13 | yes | 5 | 15 TiCN | 60 | 4.3 | ○ |
| 12-6 | 13 | yes | 2 | 30 TiCN | 75 | 4.1 | ○ |
| 12-7 | 13 | yes | 0.5 | 50 TiCN | 90 | 4.2 | ○ |

| Wear Resistance Test 8 | |
|---|---|
| Workpiece | Workpiece of FCD 700 with intermittent shape shown in FIG. 5 |
| Cutting Speed | 180 m/min |
| Feed | 0.3 mm/rev |
| Cutting Depth | 1.5 mm |
| Cutting Time | 10 minutes |
| Cutting Oil | wet process |
| Holder Used | PCLNR 2525-43 |

TABLE 25

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 12-1 | 5 | 0.27 | 0.22 | |
| 12-2 | 21 | 0.24 | 0.19 | |
| 12-3 | 70 | 0.17 | 0.16 | ○ |
| 12-4 | 105 | 0.16 | 0.09 | ○ |
| 12-5 | 162 | 0.15 | 0.07 | ○ |
| 12-6 | 173 | 0.17 | 0.08 | ○ |
| 12-7 | 141 | 0.19 | 0.07 | ○ |

The results are shown in Table 25. As is evident from this table, the inserts of the present invention, Sample Nos. 12-3 to 12-7 all show excellent breakage resistance and wear resistance, but above all, the inserts of Sample Nos. 12-4 to 12-7, in which the lower layer A of an area where tne said alumina layer has been polished consists of titanium carbonitride layer of columnar structure with an aspect ratio of at least 5, having a thickness of 3 to 30 μm, show more excellent performances in Breakage Resistance Test 3 and Wear Resistance Test 8 to give a tendency of film peeling by impacts in an intermittent cutting. The inserts of Sample Nos. 12-5 to 12-7, in which the crack intervals in the coated layer A are in a range of 0.5 to 5 μm, show particularly excellent breakage resistance and wear resistance.

EXAMPLE 13

A cemented carbide powder with a composition comprising, by weight, 90% WC-3% TiCN-1% ZrC-6% Co was pressed, sintered in vacuum at 1400° C. for 1 hour and subjected to a surface-grinding treatment and cutting edge treatment to prepare a cemented carbide insert with a Form No. ISO and a shape of CNMG 120408. When a cross section of this cemented carbide was mirror-polished and its microstructure was observed by an optical miscroscope, it was confirmed that there could be formed a β-free layer of about 20 μm on the alloy surface and an area with a higher hardness than inside the alloy directly below the β-free layer, by measurement of a cross-sectional hardness distribution.

This insert and the insert having no β-free layer on the alloy surface, prepared in Example 10, were coated with the same coated film as Sample 12-5 coated in Example 12.

Furthermore, the surface of this coated cemented carbide was subjected to a blasting treatment using an iron ball in an analogous manner to Example 10, while changing the size, projection speed, projection angle and projection time of the iron ball to prepare insert samples differing in cracked states in the coated films as shown in Table 26.

TABLE 26

| Sample No. | β-free Layer: Existing in Cemented Carbide Substrate | Crack Interval in Coated Film (μm): X Ridge of Cutting Edge | Crack Interval in Coated Film (μm): Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) |
|---|---|---|---|---|---|---|
| 13-1 | no | 8 | 80 | 10 | 60 | 4 |
| 13-2 | no | 2 | 80 | 40 | 80 | 3.5 |
| 13-3 | no | 2 | 80 | 40 | 90 | 3.5 |
| 13-4 | yes | 8 | 80 | 10 | 60 | 4 |
| 13-5 | yes | 2 | 80 | 40 | 80 | 3.5 |
| 13-6 | yes | 2 | 80 | 40 | 90 | 3.5 |

| Sample No. | Average Coated Film Thickness on Flank Face (μm) | Polishing of Alumina Layer on Ridge of Cutting Edge | Crack Interval in Coated Layer A (μm) | Aspect Ratio and Film Quality in Coated Layer A (μm) | Proportion of Cracks Existing in only TiCN Film (%) | Alumina Layer Thickness on Ridge of Cutting Edge (μm) | Within Scope of Present Invention |
|---|---|---|---|---|---|---|---|
| 13-1 | 13 | yes | 8 | 15 TiCN | 35 | 6.8 | |
| 13-2 | 13 | yes | 2 | 15 TiCN | 55 | 6.7 | ○ |
| 13-3 | 13 | yes | 2 | 15 TiCN | 70 | 6.6 | ○ |
| 13-4 | 13 | yes | 8 | 15 TiCN | 35 | 6.8 | ○ |
| 13-5 | 13 | yes | 2 | 15 TiCN | 55 | 6.7 | ○ |
| 13-6 | 13 | yes | 2 | 15 TiCN | 70 | 6.6 | ○ |

Using these inserts, Breakage Resistance Test 3 and Wear Resistance Tests 7 and 8 were then carried out in an analogous manner to Example 10 and 12. The results are shown in Table 27. The inserts of the present invention, Sample Nos. 13-1 to 13-6 all exhibit excellent breakage resistance as well as wear resistance and above all, Sample Nos. 13-4 to 13-6 each having a β-free layer on the alloy surface show more excellent breakage resistance and wear resistance, as compared with Sample Nos. 13-1 to 13-3 having no β-free layer. It is confirmed that above all, the inserts of Sample Nos. 13-5 and 13-6, in which the proportion of cracks existing in only the TiCN layer of columnar structure is at least 50%, have particularly excellent breakage resistance and wear resistance.

TABLE 27

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 13-1 | 95 | 0.18 | 0.09 | ○ |
| 13-2 | 121 | 0.15 | 0.06 | ○ |

TABLE 27-continued

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 13-3 | 139 | 0.15 | 0.05 | ○ |
| 13-4 | 145 | 0.12 | 0.08 | ○ |

TABLE 27-continued

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 13-5 | 210 | 0.11 | 0.06 | ○ |
| 13-6 | 221 | 0.10 | 0.04 | ○ |

EXAMPLE 14

An insert of the same cemented carbide having a Form No. of ISO and a shape of CNMG 120408 as that of Example 13 was prepared. This insert was then coated with the following Coated Film Quality (14) in order from the lower layer:

Film Quality (14) 0.5 μm TiN-5 μm TiCN-0.3 μm TiBN-9 μm alumina-0.2 μm TiN during which the crystal phases of alumina was changed into two kinds of κ (Sample Nos. 14-1, 14-2 and 14-3) and α (Sample Nos. 14-4, 14-5 and 14-6).

The TiCN layer was coated using acetonitrile and the crystal phase of the alumina layer was converted into κ and α by controlling the raw material gases. In addition, each sample of the resulting inserts was subjected to a treatment by a vibrating barrel to prepare various inserts differing in cracked state as shown in Table 28 (Sample Nos. 14-1 to 14-6). Using these inserts, the same cutting test as effected in Example 12 were carried out.

TABLE 28

| Sample No. | Crystal Phase of Alumina Film | Crack Interval in Coated Film (μm) X Ridge of Cutting Edge | Crack Interval in Coated Film (μm) Y Flank Face | Y/X | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers | Average Crack Length in Coated Film on Ridge of Cutting Edge (μm) |
|---|---|---|---|---|---|---|
| 14-1 | κ | 70 | 10 | 1 | 19 | 16 |
| 14-2 | κ | 25 | 44 | 2 | 55 | 12 |
| 14-3 | κ | 7 | 40 | 5.7 | 82 | 7 |
| 14-4 | α | 80 | 80 | 1 | 14 | 15.5 |
| 14-5 | α | 20 | 48 | 2 | 61 | 11.5 |
| 14-6 | α | 8 | 40 | 5.7 | 85 | 7 |

| Sample No. | Average Coated Film Thickness on Flank Face (μm) | Polishing of Alumina Layer on Ridge of Cutting Edge | Crack Interval in Coated Layer A (μm) | Aspect Ratio and Film Quality in Coated Layer A (μm) | Proportion of Cracks Existing in only TiCN Film (%) | Within Scope of Present Invention |
|---|---|---|---|---|---|---|
| 14-1 | 15 | no | 70 | 10 TiCN | 45 | |
| 14-2 | 15 | yes | 20 | 10 TiCN | 60 | ○ |
| 14-3 | 15 | yes | 7 | 10 TiCN | 80 | ○ |
| 14-4 | 15 | no | 80 | 10 TiCN | 40 | |
| 14-5 | 15 | yes | 25 | 10 TiCN | 65 | ○ |
| 14-6 | 15 | yes | 8 | 10 TiCN | 75 | ○ |

The results are shown in Table 29.

TABLE 29

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 14-1 | 3 | 0.29 | 0.24 | |
| 14-2 | 64 | 0.20 | 0.17 | ○ |
| 14-3 | 121 | 0.17 | 0.09 | ○ |
| 14-4 | 2 | 0.31 | 0.26 | |
| 14-5 | 89 | 0.20 | 0.14 | ○ |
| 14-6 | 187 | 0.15 | 0.05 | ○ |

It is apparent from this table that the inserts of the present invention, Sample Nos. 14-2, 14-3, 14-5 and 14-6 all exhibit excellent breakage resistance and wear resistance. Above all, the inserts of Sample Nos. 14-5 and 14-6, in which the crystal phase of alumina is of α-type, show excellent performances in all cutting tests and show excellent performances, in particular, in Breakage Resistance Test 3 using steel and Wear Resistance Test 8 of ductile cast iron.

EXAMPLE 15

An insert of the same cemented carbide having a Form No. of ISO and a shape of CNMG 120408 as that of Example 13 was prepared. This insert was then coated with the following Coated Film Quality⑮ in order from the lower layer:

Film Quality ⑮ 1.0 μm TiN-8 μm TiCN-0.5 μm TiBN-2 μm α-alumina-0.5 μm TiN

The TiCN layer was prepared by effecting the coating using acetonitrile as a starting gas to obtain a layer with an aspect ratio 10. In addition, the resulting insert was then subjected to a blasting treatment with an iron powder from the rake face side and flank face side, while changing the size and projection speed of the iron powder to prepare various inserts differing in cracked states, as shown in Table 30. Using these inserts, the same cutting test as that of Example 12 was carried out.

TABLE 30

| Sample No. | Crack Interval in Coated Film (μm) X Ridge of Cutting Edge | X Rake Face | Y Flank Face | Proportion of Cracks, whose Ends at Surface Side are not Penetrated to Coated Film Surface, of Cracks in Coated Film on Ridge of Cutting Edge and/or Rake Face (%) | Such Proportion (%) That Crack Ends, at Substrate Side, in Coated Film on Ridge of Cutting Edge and/or Rake Face exist in Innermost Titanium Nitride Layer, in Titanium Carbonitride Layer or in Interface between these Layers |
|---|---|---|---|---|---|
| 15-1 | 1 | 1 | 1 | 75 | 80 |
| 15-2 | 4 | 5 | 7 | 85 | 80 |
| 15-3 | 9 | 8 | 6 | 80 | 80 |
| 15-4 | 15 | 20 | 30 | 35 | 70 |
| 15-5 | 5 | 7 | 7 | 70 | 35 |
| 15-6 | 8 | 10 | 8 | 5 | 10 |

| Sample No. | Average Crack Length in Coated Film on Ridge of Cutting Edge (μm) | Average Coated Film Thickness on Flank Face (μm) | Average Crack Interval A in Titanium Carbonitride Layer on Ridge of Cutting Edge and/or Rake Face (μm) | Average Crack Interval B in Alumina Layer (μm) | B/A | Within Scope of Present Invention |
|---|---|---|---|---|---|---|
| 15-1 | 10 | 12 | 1 | 15 | 15 | ○ |
| 15-2 | 9 | 12 | 4 | 30 | 7.5 | ○ |
| 15-3 | 9 | 12 | 8 | 30 | 3.8 | ○ |
| 15-4 | 10 | 12 | 15 | 30 | 2 | |
| 15-5 | 10 | 12 | 5 | 20 | 4 | |
| 15-6 | 13 | 12 | 8 | 20 | 2.5 | |

The results are shown in Table 31.

TABLE 31

| Sample No. | Breakage Resistance Test 3 Life (sec) | Wear Resistance Test 7 Average Flank Wear Width (mm) | Wear Resistance Test 8 Average Flank Wear Width (mm) | Within Present Invention |
|---|---|---|---|---|
| 15-1 | 265 | 0.23 | 0.06 | ○ |
| 15-2 | 243 | 0.28 | 0.08 | ○ |
| 15-3 | 216 | 0.27 | 0.09 | ○ |
| 15-4 | 92 | 0.38 | 0.23 | |
| 15-5 | 114 | 0.45 | 0.25 | |
| 15-6 | 183 | 0.59 | 0.31 | |

The inserts of the present invention, Sample Nos. 15-1, 15-2 and 15-3 all exhibit excellent breakage resistance as well as wear resistance, but Sample No. 15-4, in which at most 50% of the ends of cracks at the surface side in the coated film are not penetrated to the surface of the coated film, Sample No. 15-5, in which at most 50% of the ends of cracks at the substrate side exist in the innermost titanium nitride layer, in a layer above the titanium nitride layer or in an interface between these layers, and Sample No. 15-6, in which the average crack length in the coated film is larger than the average coated film thickness on the flank face are inferior to Sample Nos. 15-1, 15-2 and 15-3 with respect to the breakage resistance and wear resistance.

The present invention has exemplarily been illustrated by Examples, but is not intended to be limited thereby.

Utility and Possibility on Commercial Scale

According to the present invention, there can be provided the coated cemented carbide tool capable of giving excellent breakage resistance and wear resistance by quantitatively specifying the crack interval and position of the ends of cracks in the coated layer on the cemented carbide.

What is claimed is:

1. A coated cemented carbide cutting tool comprising a substrate consisting of a matrix of WC and a binder phase of an iron group metal and a plurality of coated layers provided on a surface of the substrate, in which (a) an innermost layer, adjacent to the substrate, of the coated layers consists essentially of titanium nitride having a thickness of 0.1 to 3 μm, (b) on a mirror-polished cross-sectional microstructure of the said tool, an average crack interval in the coated film on a ridge of a cutting edge and/or rake face is smaller than an average crack interval in the coated layer on a flank face, (c) at least 50% of the cracks in the coated film on the said ridge of the cutting edge and/or rake face have ends of the cracks in the said innermost titanium nitride layer, in a layer above the titanium nitride layer or in an interface between these layers and (d) an average crack length of in the coated film on the said ridge of the cutting edge and/or rake face is shorter than an average coated film thickness on the flank face.

2. The coated cemented carbide cutting tool as claimed in claim 1, wherein the interface between these layers is a interface between the innermost titanium nitride layer and the layer directly above the titanium nitride layer.

3. The coated cemented carbide cutting tool as claimed in claim 1, wherein the said innermost titanium nitride layer is further coated with titanium carbonitride layer of columnar structure, with an aspect ratio of at least 5, having a thickness of 3 to 30 μm, and is further coated with at least one alumina layer of 0.5 to 10 μm.

4. The coated cemented carbide cutting tool as claimed in claim 3, wherein at least 50% of the cracks in the coated film on the said ridge of the cutting edge and/or rake face have ends of the cracks, at the substrate side, in the said innermost titanium nitride layer, in the said titanium carbonitride layer of columnar structure or in an interface between the said titanium nitride layer and the said titanium carbonitride layer of columnar structure.

5. The coated cemented carbide cutting tool as claimed in claim 3, wherein at least 50% of the cracks in the coated film on the said ridge of the cutting edge and/or rake face exist in only the said titanium carbonitride layer of columnar structure and are not penetrated to the upper and lower coated layers thereof.

6. The coated cemented carbide cutting tool as claimed in claim 1, wherein at least 80% of the cracks in the coated film on the said ridge of the cutting edge and/or rake face have ends of the cracks, at the substrate side, in the said innermost titanium nitride layer, in the said titanium carbonitride layer of columnar structure or in an interface between the said titanium nitride layer and the said titanium carbonitride layer of columnar structure.

7. The coated cemented carbide cutting tool as claimed in claim 1, wherein the said innermost titanium nitride layer is coated with alumina layer of 3 to 20 μm, further coated with titanium carbonitride layer of columnar structure with an aspect ratio of at least 5, having a thickness of 3 to 30 μm, and further coated with alumina layer of 0.5 to 10 μm.

8. The coated cemented carbide cutting tool as claimed in claim 1, wherein the average crack intervals in the coated film on the said ridge of the cutting edge and/or rake face is at most 10 μm.

9. The coated cemented carbide cutting tool as claimed in claim 1, wherein when a narrower average crack interval in the coated film of the ridge of the cutting edge or rake face on the said cross-sectional microstructure is X and an average crack interval in the coated film on the flank face is Y, a value of Y/X satisfies at least 2.

10. The coated cemented carbide cutting tool as claimed in claim 1, wherein at least 50% of the ends of cracks, at the surface side, in the coated film on the said ridge of the cutting and/or rake face are not penetrated to the surface of the coated film.

11. The coated cemented carbide cutting tool as claimed in claim 1, wherein the surface of the said cemented carbide substrate has a β-free layer.

12. The coated cemented carbide cutting tool as claimed in claim 1, wherein the cracks in the coated film on the said ridge of the cutting edge are mechanically introduced after coating.

13. The coated cemented carbide cutting tool as claimed in claim 1, wherein the said titanium carbonitride layer of columnar structure is coated at 800° C. to 1000° C. by a CVD method comprising using an organo CN compound as a reactant gas.

14. The coated cemented carbide cutting tool as claimed in claim 1, wherein the total thickness of the coated films is in a range of 3 to 50 μm.

15. A coated cemented carbide cutting tool comprising a substrate consisting of a matrix of WC and a binder phase of an iron group metal and a plurality of coated layers provided on a surface of a substrate, in which (a) an innermost layer, adjacent to the substrate, of the coated layers consists essentially of titanium nitride having a thickness of 0.1 to 3 μm, which is further coated with at least one alumina layer of 0.5 to 10 μm, (b) on a mirror-polished cross-sectional microstructure of the tool, an average crack interval in the coated film on a ridge of a cutting edge is smaller than an average crack interval in the coated layer on a flank face, (c) at least 50% of the cracks in the coated film on the said ridge of the cutting edge have ends of the cracks, at the substrate side, in the said innermost titanium nitride layer, in a layer above the titanium nitride layer or in an interface between these layers, (d) an average crack length in the coated film on the said ridge of the cutting edge is shorter than an average coated film thickness on the flank face and (e) at least one of the said alumina layers is removed or polished on at least a part of the ridge of the cutting edge.

16. The coated cemented carbide cutting tool as claimed in claim 15, wherein the said innermost titanium nitride layer is coated with at least one titanium carbonitride layer of columnar structure with an aspect ratio of at least 5, having a thickness of 3 to 30 μm.

17. The coated cemented carbide cutting tool as claimed in claim 16, wherein at least 50% of the cracks in the coated film on the said ridge of the cutting edge have ends of the cracks, at the substrate side, in the said innermost titanium nitride layer, in the said titanium carbonitride layer of columnar structure or in an interface between the said titanium nitride layer and the said titanium carbonitride layer of columnar structure.

18. The coated cemented carbide cutting tool as claimed in claim 16, wherein the surface-exposed coated layer A, where the said alumina layer has been removed, consists of titanium carbonitride layer of columnar structure with an aspect ratio of at least 5, having a thickness of 3 to 30 μm.

19. The coated cemented carbide cutting tool as claimed in claim 16, wherein the coated layer A existing under the said alumina-polished part consists of titanim carbonitride layer of columnar structure with an aspect ratio of at least 5, having a thickness of 3 to 30 μm.

20. The coated cemented carbide cutting tool as claimed in claim 16, wherein at least 50% of the cracks in the coated film on the said ridge of the cutting edge exist on only the said titanium carbonitride layer of columnar structure and are not penetrated through the upper and lower coated layers thereof.

21. The coated cemented carbide cutting tool as claimed in claim 16, wherein the said titanium carbonitride layer of columnar structure is coated at 800° C. to 1000° C. by a CVD method comprising using an organo CN compound as a reactant gas.

22. The coated cemented carbide cutting tool as claimed in claim 15, wherein at least 80% of the cracks in the coated film on the said ridge of the cutting edge have ends of the cracks, at the substrate side, in the said innermost titanium nitride layer, in the said titanium carbonitride layer of columnar structure or in an interface between the said titanium nitride layer and the said titanium carbonitride layer of columnar structure.

23. The coated cemented carbide cutting tool as claimed in claim 15, wherein the average crack inerval in the coated film on the said ridge of the cutting edge is at most 10 μm.

24. The coated cemented carbide cutting tool as claimed in claim 15, wherein when an average crack interval in the coated film of the ridge of the cutting edge on the said cross-sectional microstructure is X and an average crack interval in the coated film on the flank face is Y, a value of Y/X satisfies at least 2.

25. The coated cemented carbide cutting tool as claimed in claim 15, wherein the crack interval in the surface-exposed coated layer A, where the said alumina layer has been removed, is 0.5 to 5 μm.

26. The coated cemented carbide cutting tool as claimed in claim 15, wherein the coated layer A provided with cracks whose intervals are in a range of 0.5 to 5 μm exists under the said alumina polished part.

27. The coated cemented carbide cutting tool as claimed in claim 15, wherein the surface of the said cemented carbide substrate has a β-free layer.

28. The coated cemented carbide cutting tool as claimed in claim 15, wherein the said removed alumina layer essentially consists of κ-alumina.

29. The coated cemented carbide cutting tool as claimed in claim 15, wherein the said polished alumina layer essentially consists of α-alumina.

30. The coated cemented carbide cutting tool as claimed in claim 15, wherein the sum of the thickness of the coated layers is in a range of 3 to 50 μm.

31. The coated cemented carbide cutting tool as claimed in claim 15, wherein the cracks in the coated film on the said ridge of the cutting edge are mechanically introduced after coating.

32. A coated cemented carbide cutting tool comprising a substrate consisting of a matrix of WC and a binder phase of an iron group metal and a plurality of coated layers provided on a surface of the substrate, in which (a) an innermost layer, adjacent to the substrate, of the coated layers consists essentially of titanium nitride having a thickness of 0.1 to 3 $\mu$m, which is further coated with titanium carbonitride layer of columnar structure with an aspect ratio of at least 5, having a thickness of 3 to 30 $\mu$m, and further is coated with at least one alumina layer with a thickness of 0.5 to 10 $\mu$m, (b) on a mirror-polished cross-sectional microstructure of the said tool, at least 50% of ends of cracks at the surface side in the coated film on a ridge of a cutting edge and/or rake face are not penetrated to the surface of the coated film, (c) at least 50% of the cracks in the coated film on the said ridge of the cutting edge and/or rake face have ends of the cracks, at the substrate side, in the said innermost titanium nitride layer, in a layer above the titanium nitride layer or in an interface between these layers and (d) an average crack length in the coated film on the said ridge of the cutting edge and/or rake face is shorter than an average coated film thickness on the flank face, (e) an average crack inerval in the said titanium carbonitride layer on the said ridge of the cutting edge and/or rake face is at most 10 $\mu$m and (f) an average crack interval in the said alumina film on the said ridge of the cutting edge and/or rake face is at least two times as large as an average crack interval in the said titanium carbonitride layer.

33. The coated cemented carbide cutting tool as claimed in claim 32, wherein the surface of the said cemented carbide substrate has a β-free layer.

34. The coated cemented carbide cutting tool as claimed in claim 29, wherein the said alumina layer is removed or polished on at least a part of the ridge of the cutting edge.

* * * * *